US008845161B2

(12) United States Patent
DiPenti et al.

(10) Patent No.: US 8,845,161 B2
(45) Date of Patent: Sep. 30, 2014

(54) HEADLAMP ASSEMBLY WITH HEAT SINK STRUCTURE

(75) Inventors: Timothy DiPenti, Russell, PA (US); Michael Marley, Erie, PA (US); Todd Kolstee, North Clymer, NY (US); Ryan Smith, Lakewood, NY (US)

(73) Assignee: Truck-Lite Co., LLC, Falconer, NY (US)

( * ) Notice: Subject to any disclaimer, the term of this patent is extended or adjusted under 35 U.S.C. 154(b) by 0 days.

(21) Appl. No.: 13/024,320

(22) Filed: Feb. 9, 2011

(65) Prior Publication Data

US 2012/0201043 A1 Aug. 9, 2012

(51) Int. Cl.
*F21S 8/10* (2006.01)
*F28F 7/00* (2006.01)

(52) U.S. Cl.
CPC ..... *F21S 48/1104* (2013.01); *F21S 48/1159* (2013.01); *F21S 48/137* (2013.01); *F21S 48/328* (2013.01); *F21S 48/321* (2013.01); *F21S 48/1305* (2013.01)
USPC ..... 362/545; 362/546; 362/373

(58) Field of Classification Search
None
See application file for complete search history.

(56) References Cited

U.S. PATENT DOCUMENTS

| | | | | |
|---|---|---|---|---|
| 6,682,211 | B2 * | 1/2004 | English et al. | 362/545 |
| 6,814,475 | B2 * | 11/2004 | Amano | 362/487 |
| 6,945,672 | B2 | 9/2005 | Du et al. | |
| 7,108,412 | B2 | 9/2006 | Ishida et al. | |
| 7,156,544 | B2 * | 1/2007 | Ishida | 362/538 |
| 7,186,010 | B2 | 3/2007 | Coushaine et al. | |
| 7,306,352 | B2 | 12/2007 | Sokolov et al. | |
| 7,431,486 | B2 | 10/2008 | Bloemen et al. | |
| 7,621,667 | B2 | 11/2009 | Behr et al. | |
| 7,736,035 | B2 | 6/2010 | Chinniah et al. | |
| 7,748,879 | B2 | 7/2010 | Koike et al. | |
| 7,762,700 | B2 | 7/2010 | Luo et al. | |
| 7,789,545 | B2 | 9/2010 | Cheng et al. | |
| 7,794,128 | B2 | 9/2010 | Fujiwara et al. | |
| 7,824,076 | B2 | 11/2010 | Koester | |
| 7,905,632 | B2 | 3/2011 | Dobler et al. | |
| 7,994,725 | B2 | 8/2011 | Bouchard | |
| 8,159,144 | B2 | 4/2012 | Behr et al. | |
| 8,193,553 | B2 | 6/2012 | Chen | |
| 2003/0227774 | A1 * | 12/2003 | Martin et al. | 362/240 |
| 2005/0122018 | A1 * | 6/2005 | Morris | 313/46 |
| 2006/0187653 | A1 * | 8/2006 | Olsson | 362/111 |
| 2007/0195545 | A1 * | 8/2007 | Sato et al. | 362/538 |
| 2008/0225544 | A1 * | 9/2008 | Fujiwara et al. | 362/538 |
| 2009/0080211 | A1 * | 3/2009 | Yasuda | 362/547 |
| 2009/0097247 | A1 * | 4/2009 | Tseng et al. | 362/241 |
| 2009/0207617 | A1 | 8/2009 | Merchant et al. | |
| 2009/0213613 | A1 | 8/2009 | Mitic et al. | |
| 2010/0033972 | A1 | 2/2010 | Maglica et al. | |
| 2010/0194276 | A1 | 8/2010 | Okubo et al. | |
| 2010/0213809 | A1 | 8/2010 | Roehl et al. | |
| 2011/0149584 | A1 | 6/2011 | Stade et al. | |

* cited by examiner

*Primary Examiner* — Britt D Hanley
(74) *Attorney, Agent, or Firm* — The Bilicki Law Firm, P.C.; Rebecca M.K. Tapscott; Byron A. Bilicki

(57) ABSTRACT

A headlamp assembly for a vehicle includes a housing for coupling the headlamp assembly to a vehicle. The housing includes a reflector and a planar heat sink is positioned therein. The planar heat sink structure includes a first surface and a second surface for supporting a circuit board, a first light emitting diode assembly, and a second light emitting diode assembly. The headlamp assembly is adapted to emit a high beam and a low beam and the headlamp assembly is completely bisected by the planar heat sink structure.

83 Claims, 21 Drawing Sheets

HEADLAMP ASSEMBLY WITH HEAT SINK STRUCTURE

DETAILED DESCRIPTION

Figure 1:
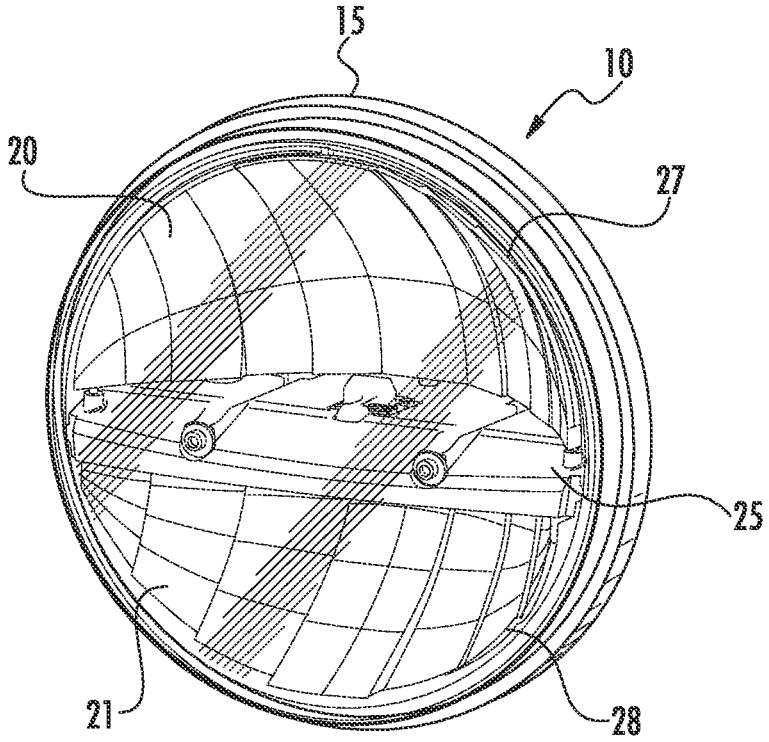
FIG. 1 is a first embodiment of a headlamp assembly with a heat sink structure.
Figure 2:
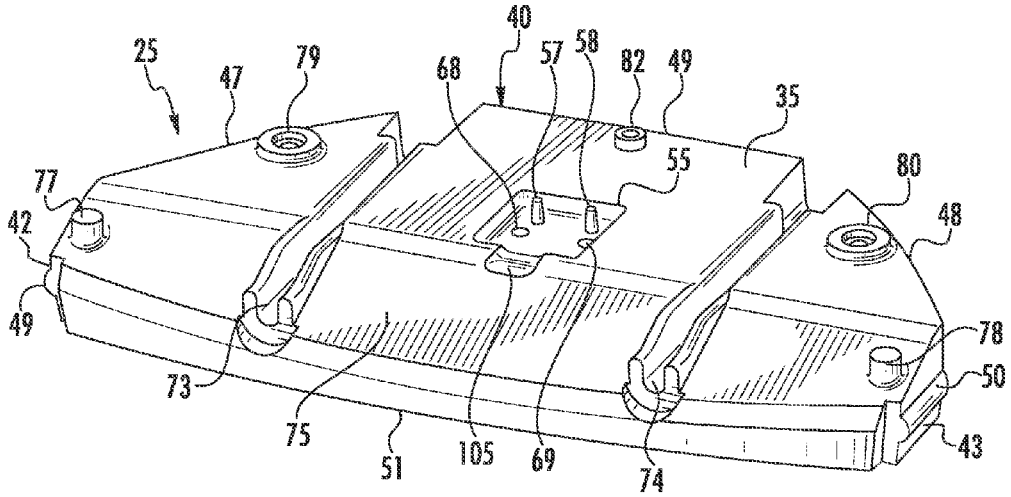
FIG. 2 is a perspective view of a first surface of the heat sink structure of the headlamp of FIG. 1.

As shown in FIG. 1, a first embodiment of a headlamp assembly 10 for a vehicle includes a 7-in round housing 15 for coupling headlamp assembly 10 to the vehicle, first and second reflector portions 20 and 21 and a heat sink structure 25, which bisects housing 15 into upper and lower areas, 27 and 28. Heat sink structure 25 supports light emitting diode assemblies and a circuit board, as will be discussed in detail below. Headlamp assembly includes a lens 30. Lens 30 may be formed of a hard-coated polycarbonate that is glued to housing 15 using a two component urethane. In one embodiment, lens 30 includes a copper wire heating element for melting snow or ice.

Figure 3:
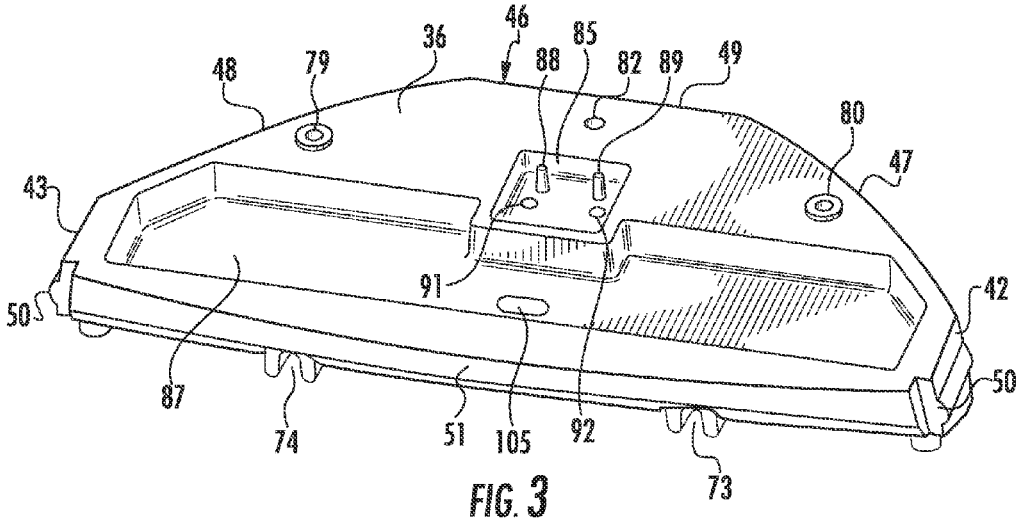
FIG. 3 is a perspective view of a second surface of the heat sink structure of the headlamp of FIG. 1.

One embodiment of heat sink structure 25 is illustrated in FIGS. 2-5. In particular, heat sink structure 25 includes a first surface 35 (FIG. 2) and a second surface 36 (FIG. 3). Heat sink structure 25 also includes a housing abutting edge 40 which is made up of first and second side edges, 42 and 43, first and second curved edges, 47 and 48, and back edge 49. Side edges 42 and 43 also include alignment ribs 50 for aligning heat sink structure 25 within housing 15.

Heat sink structure 25 also includes a substantially straight edge 51, which is positioned near lens 30 in headlamp assembly 10. As illustrated in FIG. 3, first surface 35 includes a first light emitting diode receiving portion 55, which may take the form of an indented area sized to receive a light emitting diode. Alignment posts, 57 and 58, may be formed in first light emitting diode receiving portion 55 for aligning with datum features in a first light emitting diode assembly 65. Thus, first light emitting diode assembly 65 may be accurately located on heat sink structure 25. In addition, first light emitting diode receiving portion 55 has holes 68 and 69 formed therein for accepting fasteners, 70 and 71, used for securing first light emitting diode assembly 65 to heat sink structure 25 in the same plane as first surface 35. First surface 35 also includes fastener receiving channels 73 and 74 for facilitating the attachment of screws for joining heat sink structure 25 and housing 15. A front angled portion 75 of heat sink structure 25 is located near substantially straight edge 51. Upstanding supports 77 and 78 are also formed at each side of front angled portion 75 for supporting first reflector portion 20, as will be described in detail below. Heat sink structure 25 also includes apertures 79 and 80 for receiving fasteners, generally indicated at 81, for securing first and second reflector portions, 20 and 21, to heat sink structure 25. An additional aperture 82 is located adjacent to back edge 49 of housing abutting edge 40 of heat sink structure 25. Aperture 82 is adapted to receive alignment projections 83 and 84 of first and second reflector portions, 20 and 21, for facilitating the positioning of first and second reflector portions, 20 and 21, on heat sink structure 25.

As illustrated in FIG. 3, the second surface 36 of heat sink structure 25 includes a second light emitting diode receiving portion 85 and a circuit board receiving portion 87 formed therein. Second light emitting diode receiving portion 85 includes alignment posts, 88 and 89, formed therein for aligning with datum features in a second light emitting diode assembly 90. Apertures 91 and 92 are also formed therein for accepting fasteners, 93 and 94, used for securing second light emitting diode assembly 90 to heat sink structure 25 in the same plane as second surface 36. In one embodiment, circuit board receiving portion 87 is positioned near substantially straight edge 51 of heat sink structure 25 and light emitting diode receiving portion 85 is positioned near the housing abutting edge 40 of the heat sink structure. Thus, second light emitting diode receiving portion 85 and circuit board receiving portion 87 are adapted to support second light emitting diode 95 and a circuit board 100 in a same plane as second surface 36.

Figure 4:
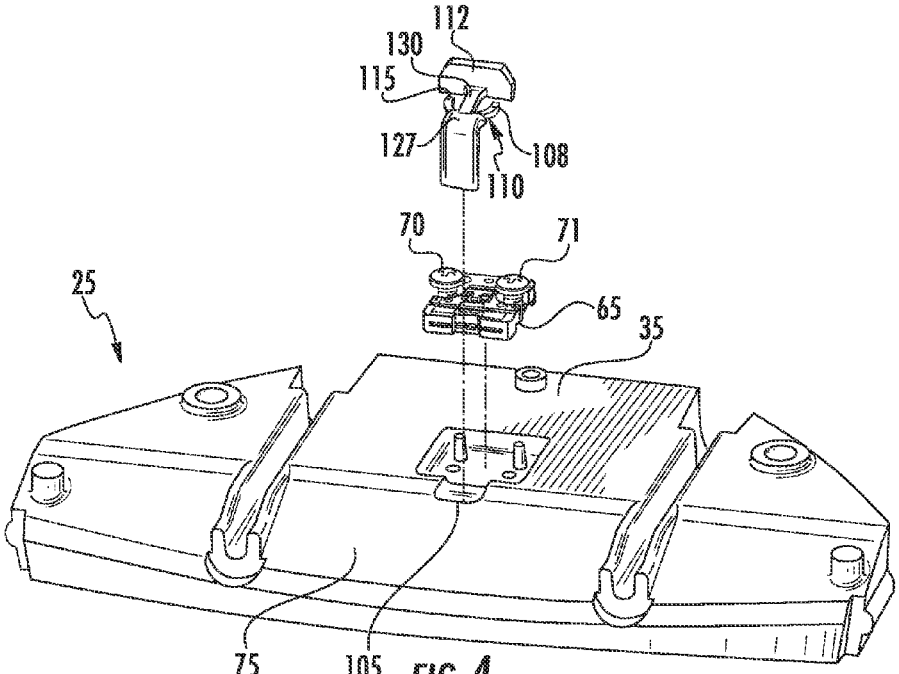
FIG. 4 is an exploded view of heat sink structure 25 with first surface 35 facing up.

FIG. 4 is an exploded view of heat sink structure 25 with first surface 35 facing up. First light emitting diode assembly 65 is shown above first light emitting diode receiving portion 55. Alignment posts 57 and 58 correspond to apertures in first light emitting diode assembly 65. In addition, holes 68 and 69 formed within first light emitting diode receiving portion 55 align with fastener alignment features 102 and 103 such that fasteners 70 and 71 may secure first light emitting diode assembly 65 to heat sink structure 25. In the embodiment shown, first light emitting diode assembly 65 is a 1×2 Altilon LED Assembly manufactured by Philips Lumiled. A thermally conductive compound may be positioned between heat sink structure 25 and first light emitting diode assembly 65. The thermally conductive compound may be a material such as thermal grease, phase change material, thermal epoxy, or thermal tape. An elongated opening 105 is also formed within first surface 35 of heat sink structure 25. Elongated opening 105 is formed adjacent to first light emitting diode receiving portion 55 along front angled portion 75 of first surface 35 and is adapted to receive thermal stampings 108 from a combined buss bar and light blinder assembly 110.

Combined buss bar and light blinder assembly 110 includes a buss bar portion 111 and a light blinder portion 112. Bus bar portion 111 includes thermal stampings 108 that contact first light emitting diode assembly 65 at a first ends 115 and extend through elongated opening 105 of heat sink structure 25 at a second ends 117. Second ends 114 contact a circuit board 125 at openings 128 in circuit board 125, thereby forming an electrical connection between first light emitting diode assembly 65 and heat sink structure 25. Second ends 114 of buss bar portion 111 may be soldered to circuit board 125 and first ends 115 of buss bar portion 111 may be soldered to first light emitting diode assembly 65. An overmold 127 is positioned over thermal stampings 108 to insulate thermal stampings from heat sink structure 25, which is formed of a conductive material. Overmold 127 may be formed of a material suitable for high temperature applications, such as a glass filled nylon material. As noted above, first ends 115 and second ends 117 are left uncovered to provide the necessary electrical contacts. In one embodiment, thermal stampings 108 are made of tin plated brass.

Light blinder portion 112 of heat sink structure 25 may be connected to overmold 127 with an integral extension 130. In one embodiment, light blinder portion 112 blocks light from approximately (i.e. glare zone) in a photometric pattern. Light blinder portion 112 may include bottom projections 133 for contacting first light emitting diode assembly 65. Therefore, light blinder portion 112 is positioned perpendicular to first light emitting diode assembly 65 as shown in FIG. 6.

Figure 5:
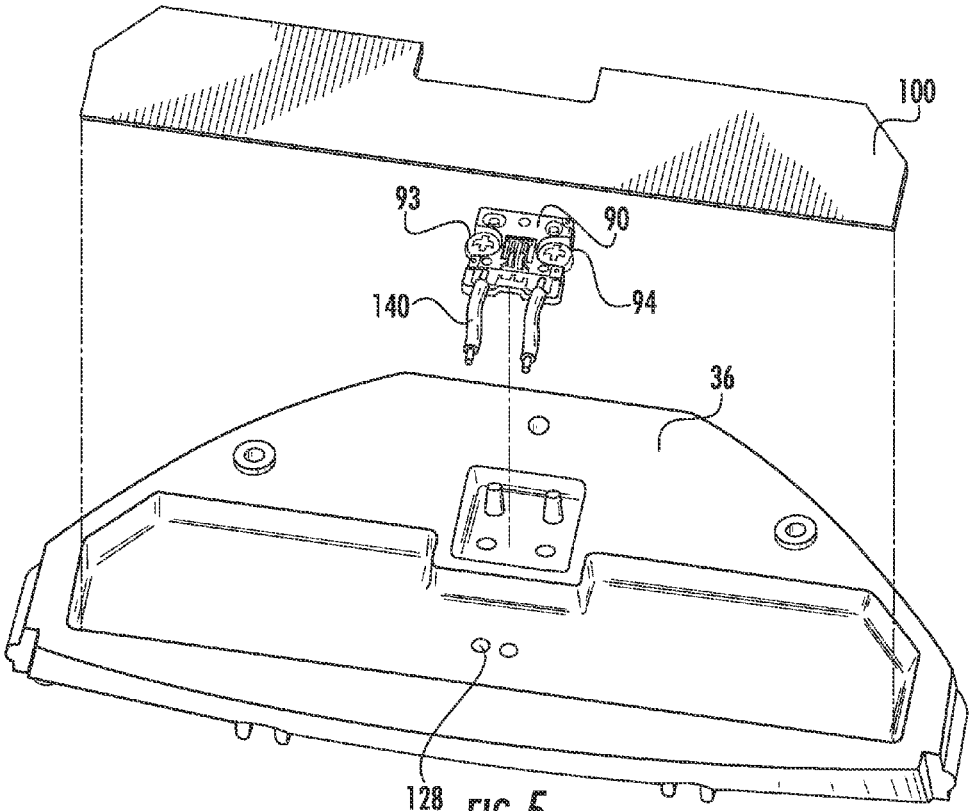
FIG. 5 is an exploded view of second surface 36 of heat sink structure 25.

FIG. 5 is an exploded view of second surface 36 of heat sink structure 25 with second light emitting diode 95 and a circuit board 125 positioned above second light emitting diode receiving portion 85 and circuit board receiving portion 87, respectively. In one embodiment, jumper wires 140 used to make an electrical connection between second light emitting diode 95 and a circuit board 125. Alternatively, a ribbon cable, buss bar, or other suitable device may be used to make an electrical connection.

As illustrated, circuit board receiving portion 87 includes elongated opening 105, which extends through heat sink structure 25 from first surface 35. Second ends 117 of thermal stampings 108 extend through elongated opening 105 such that second ends 117 contact circuit board 100 at that contact first light emitting diode assembly 65 at a first ends 115 and extend through elongated opening 105 of heat sink structure 25 at a second ends 117. In the embodiment shown, second light emitting diode assembly 95 is a 1×4 Altilon LED Assembly manufactured by Philips Lumiled.

Figure 6:
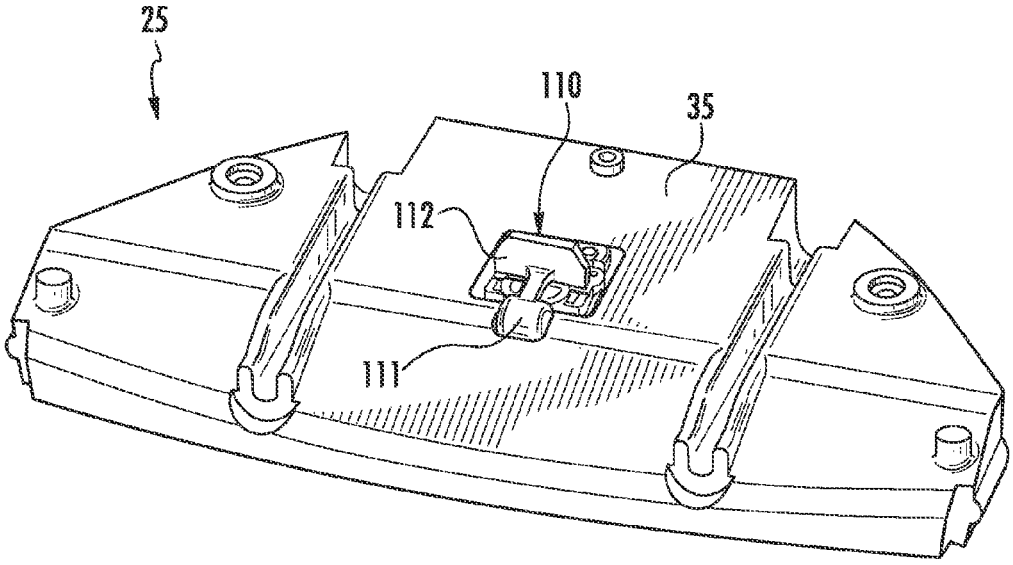
FIG. 6 illustrates first surface of heat sink structure in an assembled configuration.
Figure 7:
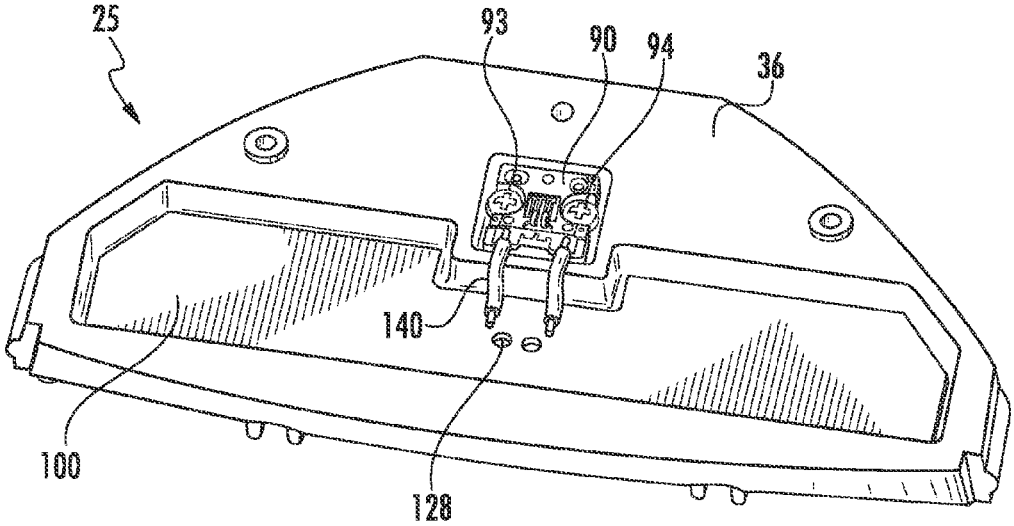
FIG. 7 illustrates second surface of heat sink structure in an assembled configuration.

FIGS. 6 and 7 illustrate first and second surfaces, 35 and 36, of heat sink structure 25 in an assembled configuration. In FIG. 6, first surface 35 is shown with first light emitting diode assembly 65 positioned within the first light emitting diode receiving portion 55. In addition, combined buss bar and light blinder assembly 110 is shown with buss bar portion 111 extending into and through elongated opening 105 formed in first surface 35 and light blinder portion 112 is perpendicular to first light emitting diode assembly 65 such that light emitted in the 10U to 90U range is shielded.

FIG. 7 illustrates second surface 36 having circuit board 100 positioned within circuit board receiving portion 87. Although not shown, circuit board 100 includes electrical components on each side thereof. In one embodiment a thermal material, such as a GAP pad, is used on a bottom side of circuit board 100 in order to improve thermal contact between the electrical components and heat sink structure 25. In the embodiment shown in FIG. 7, jumper wires 140 are shown to provide an electrical connection between second light emitting diode assembly 90 and circuit board 100.

Figure 8B:
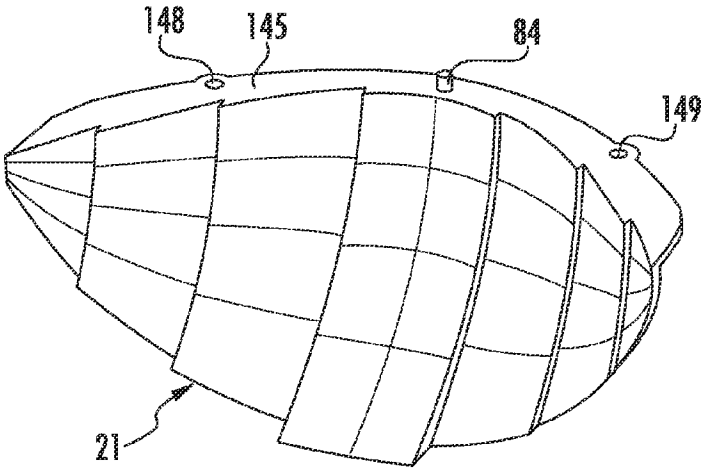
FIGS. 8*a* and 8*b* illustrate first and second reflector portions of the headlamp assembly of FIG. 1.
Figure 8A:
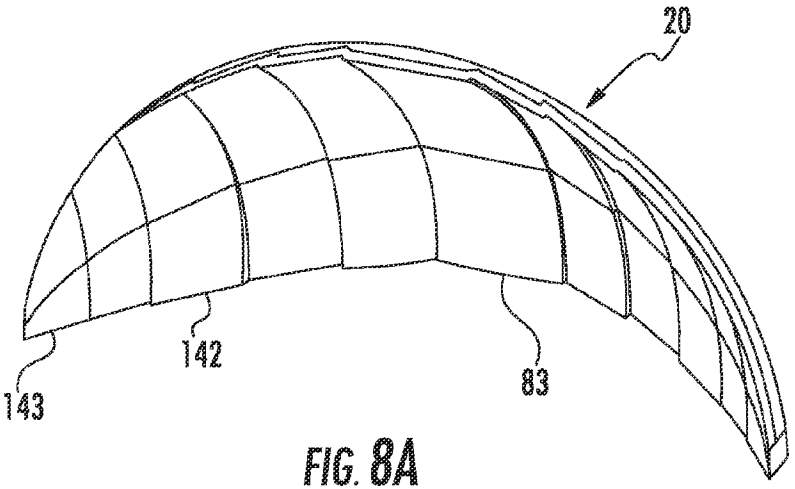

As illustrated in FIGS. 8*a* and 8*b*, headlamp assembly 10 includes first and second reflector portions, 20 and 21. First reflector portion 20 is a low beam reflector and second reflector portion 21 is a high beam reflector. Both first and second reflector portions, 20 and 21, are molded and metalized. In addition, each of first and second reflector portions, 20 and 21, have a complex reflector optic design. The complex reflector optical design includes multiple intersecting segments. The segments intersect at points that may be profound and visible or blended to form a uniform single surface. First reflector portion 20 includes a heat sink abutting edge 142 having an alignment projections 83 for fitting within aperture 82 formed in first surface 35 of heat sink structure 25. Apertures (not shown) formed on heat sink abutting edge 142 of first reflector portion 20 align with apertures 79 and 80 of heat sink structure 25 for receiving fasteners 81 for securing first reflector portion 20 to heat sink structure 25. First reflector portion 20 also includes projections, one of which is indicated at 143, formed on heat sink abutting edge 142 for contacting upstanding supports 77 and 78 formed on first surface 35 of heat sink structure 25. Similarly, second reflector portion 21 includes a heat sink abutting edge 145 having alignment projection 84 for fitting within aperture 82 formed in second surface 36 of heat sink structure 25. Additional apertures, 148 and 149, formed within heat sink abutting edge 145 of second reflector portion 21 align with apertures 79 and 80 of heat sink structure 25 for receiving fasteners 81 for securing second reflector portion 21 to heat sink structure 25.

Figure 9A:
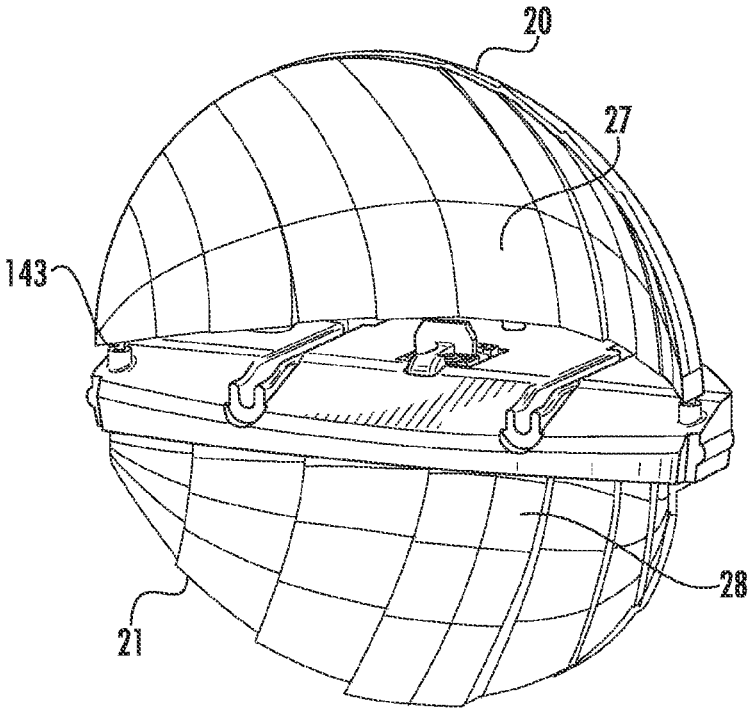
FIGS. 9*a* and 9*b* illustrate heat sink structure is positioned between first and second reflector portions.
Figure 9B:
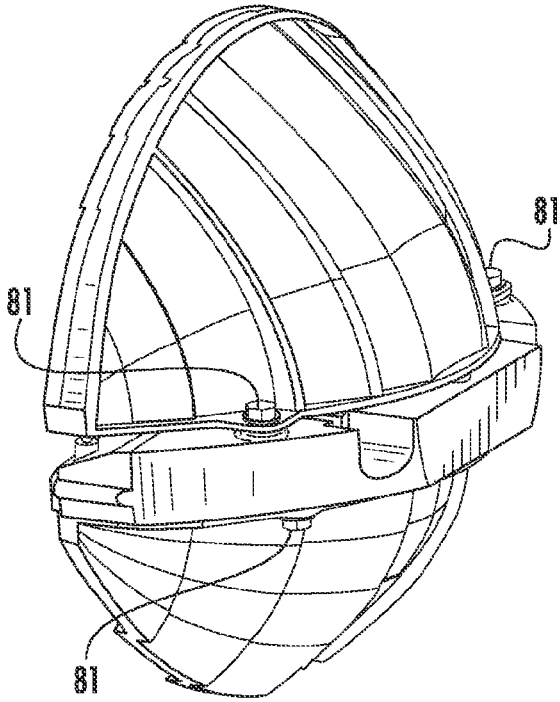

When assembled, as illustrated in FIGS. 9*a* and 9*b*, heat sink structure 25 is positioned between first and second reflector portions, 20 and 21, thereby creating an upper area 27 and a lower area 28. Heat sink structure prevents light from upper area 27 area from impinging on second reflector portion 21 and prevents light from lower area 28 from impinging on first reflector portion 20. Heat sink abutting edge 143 of second reflector portion 21 contacts heat sink along heat sink abutting edge 143. However, heat sink abutting edge 142 of first reflector portion 20 does not contact heat sink structure 25 at front angled portion 75 thereof. Thus, projections 143 of first reflector portion 20 contact upstanding supports 77 and 78 formed on first surface 35 of heat sink structure 25 such that a contact point is provided between front angled portion 75 of heat sink structure 25 first reflector portion 20. Upstanding supports 77 and 78 provide stability and prevent vibration of reflector portion 20. Front angled portion 75 of heat sink structure 25 serves to allow light reflected first reflector portion 20 to fill foreground photometric requirements.

Figure 10:
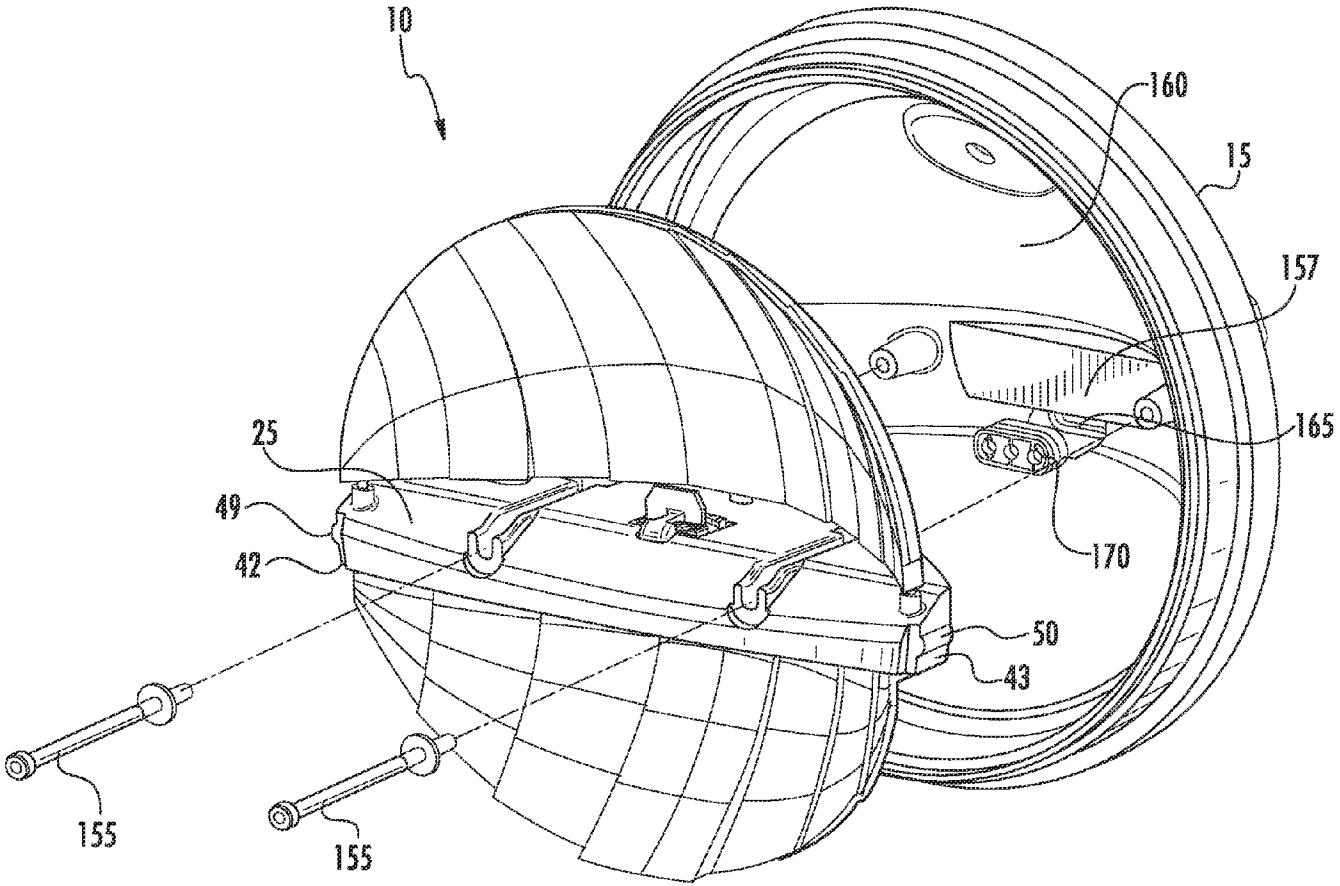
FIG. 10 is an exploded view of the headlamp assembly of FIG. 1.

FIG. 10 is an exploded view of headlamp assembly 10 for illustrating the manner in which heat sink structure 25 and first and second reflector sections, 20 and 21, are attached to housing 15. As discussed with respect to FIGS. 3 and 4, heat sink structure 25 includes side edges 42 and 43 having alignment ribs 50 for aligning heat sink structure 25 within housing 15. Housing 15 includes an alignment member, such as an alignment rib receiving channel, formed on each end thereof. Therefore, alignment ribs 50 cooperate with alignments members of housing 15 to ensure that heat sink structure 25 is in a proper position upon insertion into housing 15. Housing 15 includes bosses formed therein for aligning with fastener receiving channels 73 and 74 of heat sink structure 25 and for receiving fasteners, generally indicated at 155, for securing heat sink structure 25 and housing 15. A flat surface 157 is formed on inner surface 160 of housing for contacting back edge 49 of heat sink structure. A thermally conductive material, such as thermal grease, phase change material, thermal epoxy, or thermal tape, may be placed between back edge 49 of heat sink structure 25 and flat surface 157 of housing 15. An opening 165 for a wire seal 170 is also formed within housing 15 to allow wires to exit housing 15. Housing 15 may be formed of die-cast aluminum that is anodized black for improved thermal emissivity. Housing 15 also functions as a heat sink for first and second light emitting diode assemblies and circuit board 100.

Figure 11:
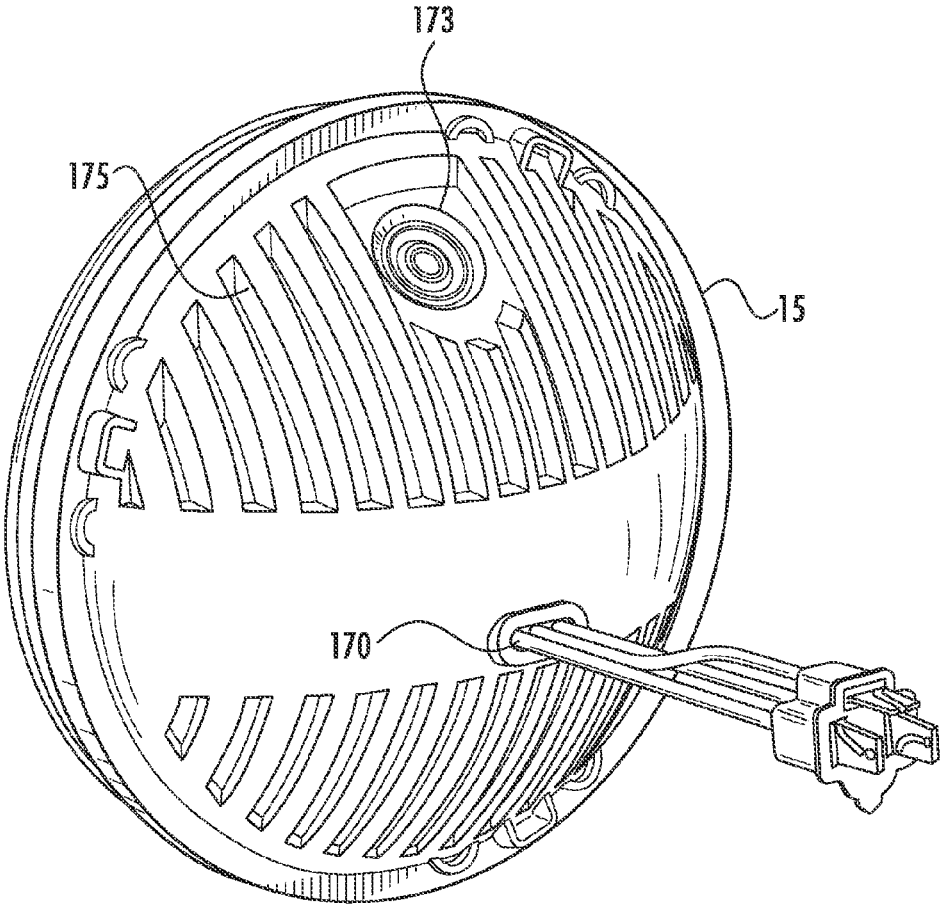
FIG. 11 is back view of the headlamp assembly of FIG. 1.

As illustrated in FIG. 11, a back surface 172 of housing 15 may include fins 175 for providing increased surface area and greater heat dissipation. Housing 15 also functions as a heat sink for first and second light emitting diode assemblies, 65 and 90, and circuit board 100. Housing also serves to provide environmental protection for first and second light emitting diode assemblies, 65 and 90, circuit board 100, and any wiring components. A Gore-Tex patch 173 is placed within an opening in housing 15 to prevent water from entering headlamp assembly 10 while allowing water vapor to escape. Housing 15 also provides a mounting interface for attaching headlamp assembly 10 to a vehicle. In general, headlamp assembly 10 is mounted to a vehicle through the use of bucket assemblies, as is known in the art.

Headlamp assembly 10 is adapted to emit both high and low beams. A low beam pattern is emitted when first light emitting diode assembly 65 is illuminated. A high beam pattern is emitted from headlamp assembly when both first light emitting diode assembly 65 and second light emitting diode assembly 90 are simultaneously illuminated.

Figure 12:
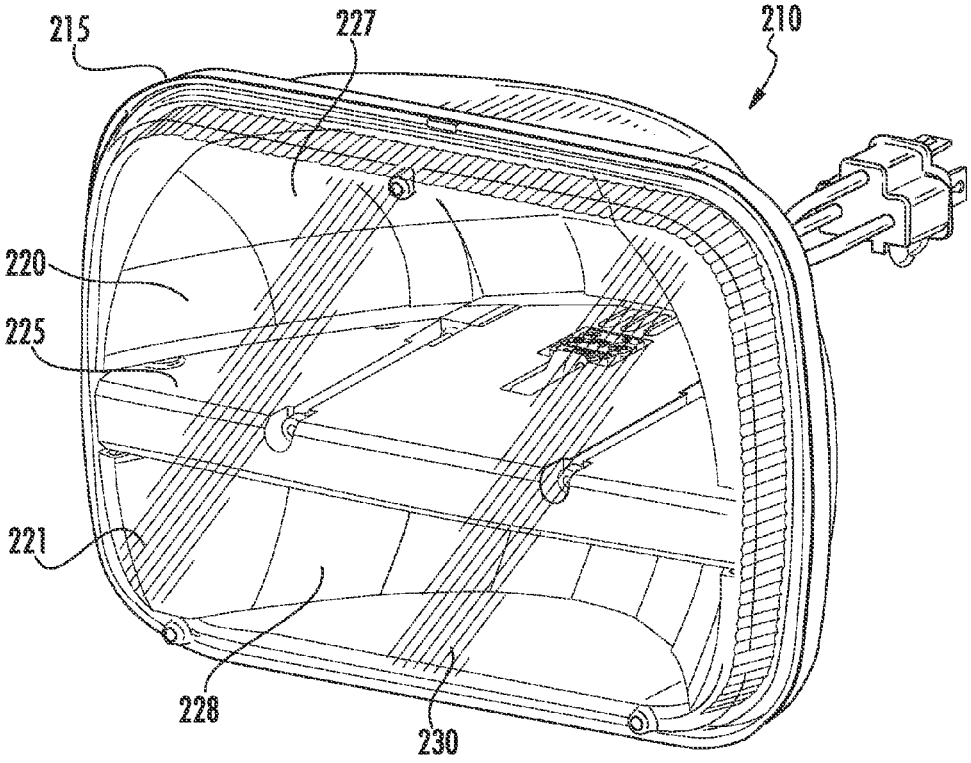
FIG. 12 is a second embodiment of a headlamp assembly with a heat sink structure.

A second embodiment of is generally indicated at 210 in FIG. 12. Headlamp assembly 210 includes a 5×7 housing 215 for coupling headlamp assembly 210 to the vehicle, first and second reflector portions 220 and 221, and a heat sink structure 225 that bisects housing into upper and lower areas, 227 and 228. Heat sink structure 225 supports light emitting diode assemblies and a circuit board, as will be discussed in detail below. Headlamp assembly 210 includes a lens 230. Lens 230 may be formed of a hard-coated polycarbonate that is glued to housing 215 using a two component urethane. Optical elements 231 are formed in lens 230 around the perimeter of lens 230 to diffuse light in the 10 U-90 U glare zone. In one embodiment, lens 230 includes a copper wire heating element for melting snow or ice. Headlamp assembly 210 is designed for mechanical aiming by the use of aiming pads (not shown) on an exterior surface of lens 230. A mechanical aimed lamp is generally designed to meet specific photometric requirements.

Figure 13:
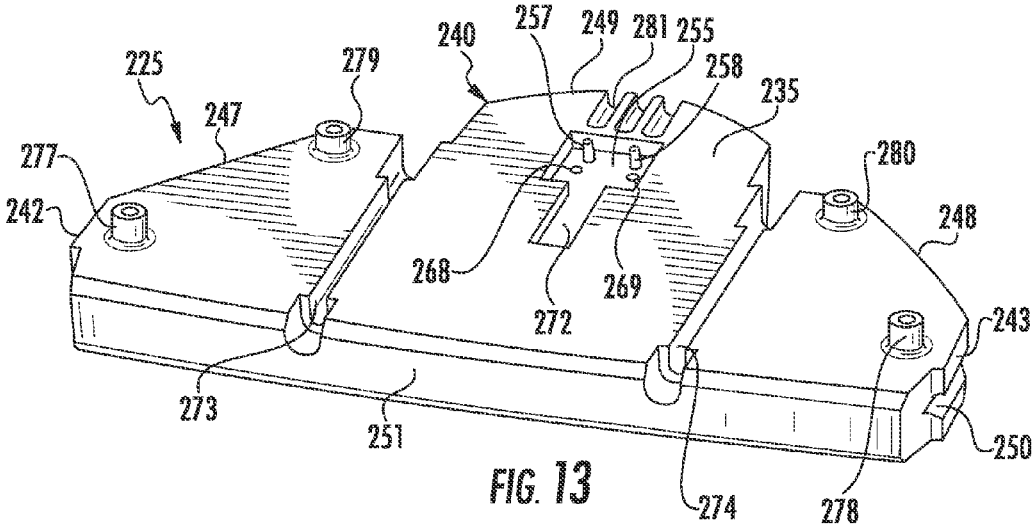
FIG. 13 is a perspective view of a first surface of the heat sink structure of the headlamp of FIG. 12.
Figure 14:
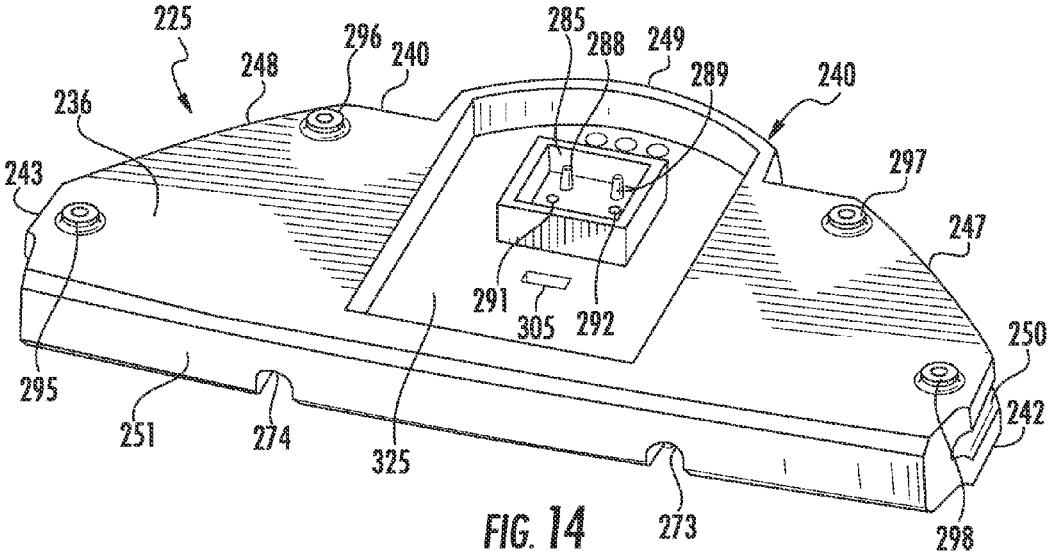
FIG. 14 is a perspective view of a second surface of the heat sink structure of the headlamp of FIG. 12.

One embodiment of heat sink structure 225 is illustrated in FIGS. 13-16. In particular, heat sink structure 225 includes a first surface 235 (FIG. 13) and a second surface 236 (FIG. 14). Heat sink structure 225 also includes a housing abutting edge 240 which is made up of first and second side edges, 242 and 243, first and second curved edges, 247 and 248, and back edge 249. Side edges 242 and 243 also include alignment slots 250 for aligning heat sink structure 225 within housing 215. Heat sink structure 225 also includes a substantially straight edge 251, which is positioned near lens 230 in headlamp assembly 210.

As illustrated in FIG. 13, first surface 235 includes a first light emitting diode receiving portion 255, which may take the form of an indented area sized to receive a light emitting diode. Alignment posts, 257 and 258, may be formed in first light emitting diode receiving portion 255 for aligning with datum features in a first light emitting diode assembly 265. Thus, first light emitting diode assembly 265 may be accurately located on heat sink structure 225. In addition, first light emitting diode receiving portion 255 has holes 268 and 269 formed therein for accepting fasteners, 270 and 271, used for securing first light emitting diode assembly 265 to heat sink structure 225 in the same plane as first surface 235. A BUSS bar receiving portion 272 is also formed in first surface 235, as will be described in more detail below. First surface 235 also includes fastener receiving channels 273 and 274 for facilitating the attachment of screws for joining heat sink structure 225 and housing 215. Front upstanding bosses 277 and 278 are also formed adjacent to each of first and second side edges 242 and 243 for receiving fasteners for attaching first reflector portion 220 to heat sink structure 225, as will be described in detail below. Heat sink structure 225 also includes rear upstanding bosses 279 and 280 for receiving fasteners for securing first and second reflector portions 220 and 221 to heat sink structure 225. Wire channels 281 are also formed within heat sink structure for providing a passage for wires 282.

As illustrated in FIG. 14, second surface 236 of heat sink structure 225 includes a second light emitting diode receiving portion 285 and a circuit board receiving portion 287 formed therein. In the embodiment shown, second light emitting diode receiving portion 285 is composed of upstanding walls for surrounding a second light emitting diode 290, which is positioned within circuit board receiving portion 287. Second light emitting diode receiving portion 285 includes alignment posts, 288 and 289, formed therein for aligning with datum features in second light emitting diode assembly 290. Apertures 291 and 292 are also formed therein for accepting fasteners, 293 and 294, used for securing second light emitting diode assembly 290 to heat sink structure 225 in the same plane as second surface 236. Second surface 236 of heat sink structure 225 also includes apertures 295-298 formed adjacent to housing abutting edge 240 for facilitating the attachment of second reflector portion 221 to heat sink structure 225.

Figure 15:
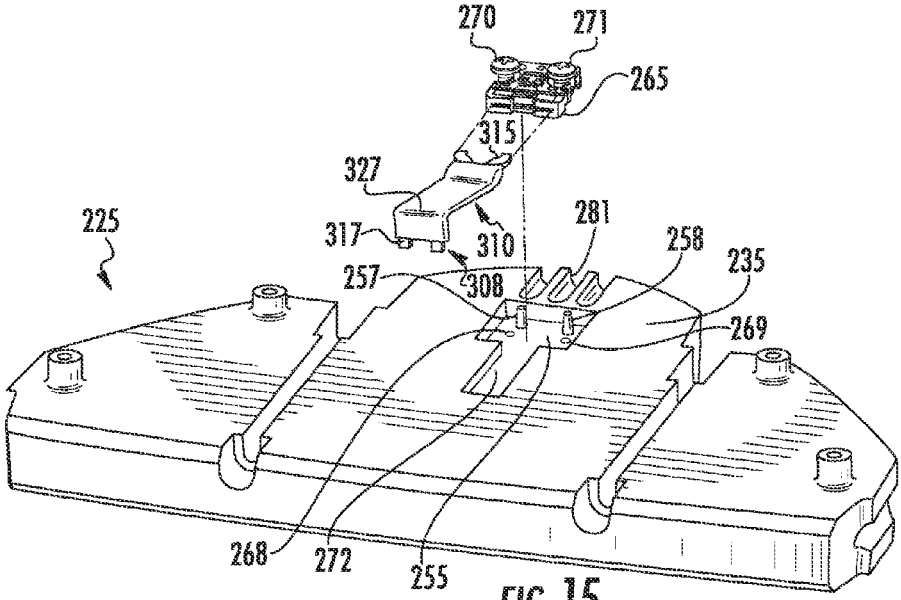
FIG. 15 is an exploded view of the heat sink structure with the first surface facing up.

FIG. 15 is an exploded view of heat sink structure 225 with first surface 235 facing up. First light emitting diode assembly 265 is shown above first light emitting diode receiving portion 255. Alignment posts 257 and 258 correspond to apertures in first light emitting diode assembly 265. In addition, holes 268 and 269 formed within first light emitting diode receiving portion 255 are adapted to receive fasteners 270 and 271 for securing first light emitting diode assembly 265 to heat sink structure 225. In the embodiment shown, first light emitting diode assembly 265 is a 1×4 Altilon LED Assembly manufactured by Philips Lumiled. A thermally conductive compound may be positioned between heat sink structure 225 and first light emitting diode assembly 265. The thermally conductive compound may be a material such as thermal grease, phase change material, thermal epoxy, or thermal tape. An elongated opening 305 is also formed through heat sink structure 225, as shown in FIG. 14. Elongated opening 305 is formed adjacent to BUSS bar receiving portion 272 and is adapted to receive thermal stampings 308 from BUSS bar 310.

BUSS bar 310 includes thermal stampings 308 that contact first light emitting diode assembly 265 at a first ends 315 and extend through elongated opening 305 of heat sink structure 225 at a second ends 317. Second ends 317 contact a circuit board 325 through elongated opening 305, thereby forming an electrical connection between first light emitting diode assembly 265 and heat sink structure 225. First ends 315 of buss bar 310 may be soldered to first light emitting diode assembly 265. An overmold 327 is positioned over thermal stampings 308 to insulate thermal stampings from heat sink structure 225, which is formed of a conductive material. As noted above, first ends 315 and second ends 317 are left uncovered to provide the necessary electrical contacts. In one embodiment, thermal stampings 308 are made of tin plated brass.

Figure 16:
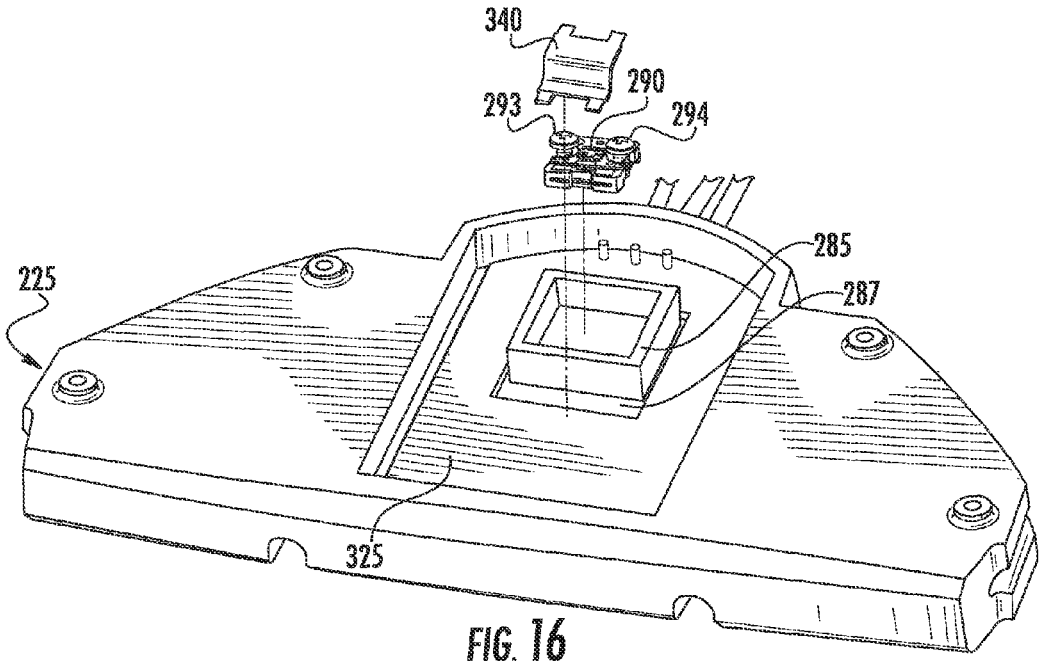
FIG. 16 is an exploded view of the second surface of the heat sink structure of the headlamp of FIG. 12.

FIG. 16 is an exploded view of second surface 236 of heat sink structure 225 with second light emitting diode 290 and a circuit board 325 positioned above second light emitting diode receiving portion 285 and circuit board receiving portion 287, respectively. In one embodiment, a flat ribbon cable 340 is used to make an electrical connection between second light emitting diode 290 and circuit board 325. Alternatively, jumper wires, a buss bar, or other suitable device may be used to make an electrical connection. In the embodiment shown, second light emitting diode assembly 290 is a 1×4 Altilon LED Assembly manufactured by Philips Lumiled.

Figure 17:
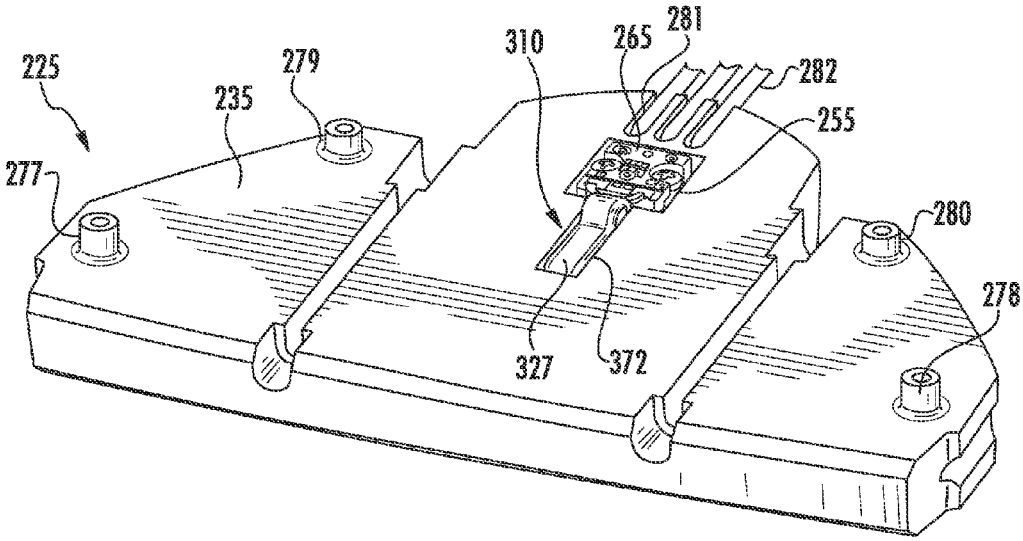
FIG. 17 illustrates first surface of heat sink structure of the headlamp of FIG. 12 in an assembled configuration.
Figure 18:
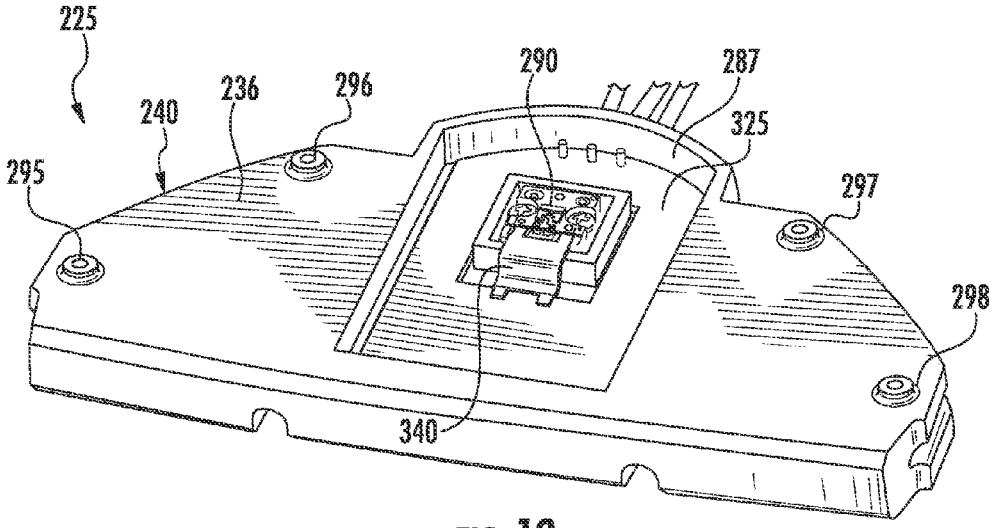
FIG. 18 illustrates second surface of heat sink structure of the headlamp of FIG. 12 in an assembled configuration.

FIGS. 17 and 18 illustrate first and second surfaces, 235 and 236, of heat sink structure 225 in an assembled configuration. In FIG. 17, first surface 235 is shown with first light emitting diode assembly 265 positioned within the first light emitting diode receiving portion 255. In addition, buss bar 310 is shown with overmold 327 fitted within BUSS bar receiving portion 272. Wires 282 extend from first light emitting diode assembly 265 through wire channels 281 formed in first surface 235 of heat sink structure 225.

FIG. 18 illustrates second surface 236 having circuit board 325 positioned within circuit board receiving portion 287. Although not shown, circuit board 325 includes electrical components on each side thereof. In one embodiment a thermal material, such as a GAP pad, is used on a bottom side of circuit board 325 in order to improve thermal contact between the electrical components and heat sink structure 225. In the embodiment shown in FIG. 18, a flat ribbon cable 340 is used to provide an electrical connection between second light emitting diode assembly 290 and circuit board 325.

Figure 19B:
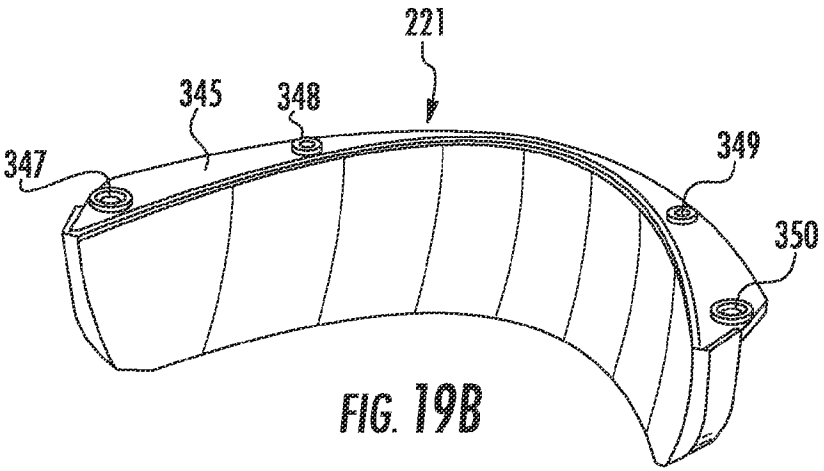
FIGS. 19*a* and 19*b* illustrate first and second reflector portions of the headlamp assembly of FIG. 12.
Figure 19A:
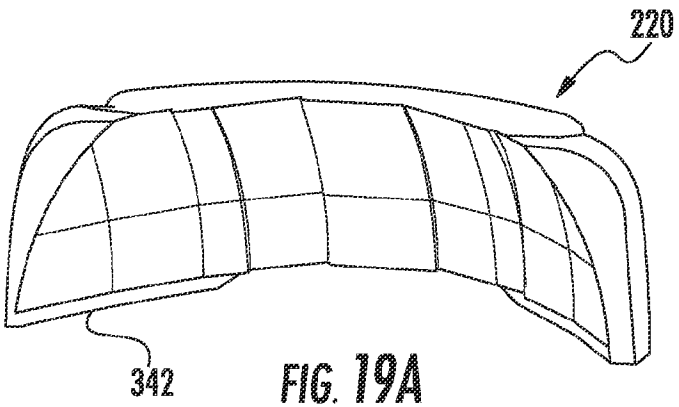

As illustrated in FIGS. 19*a* and 19*b*, headlamp assembly 210 includes first and second reflector portions 220 and 221. First reflector portion 220 is a low beam reflector and second reflector portion 221 is a high beam reflector. Both first and second reflector portions 220 and 221 are molded and metalized. In addition, each of first and second reflector portions 220 and 221 have a complex reflector optic design. First reflector portion 220 includes a heat sink abutting edge 342 having apertures (not shown) formed therein for aligning with upstanding bosses 277-280 of first surface 235 of heat sink structure 225. Fasteners 281 are used to secure first reflector portion 220 to heat sink structure 225. Similarly, second reflector portion 221 includes a heat sink abutting edge 345 having apertures 347-350 formed therein for aligning with apertures 295-298 formed in second surface 236 of heat sink structure 225. Fasteners 281 extend through the apertures to secure second reflector portion 221 to heat sink structure 225.

Figure 20A:
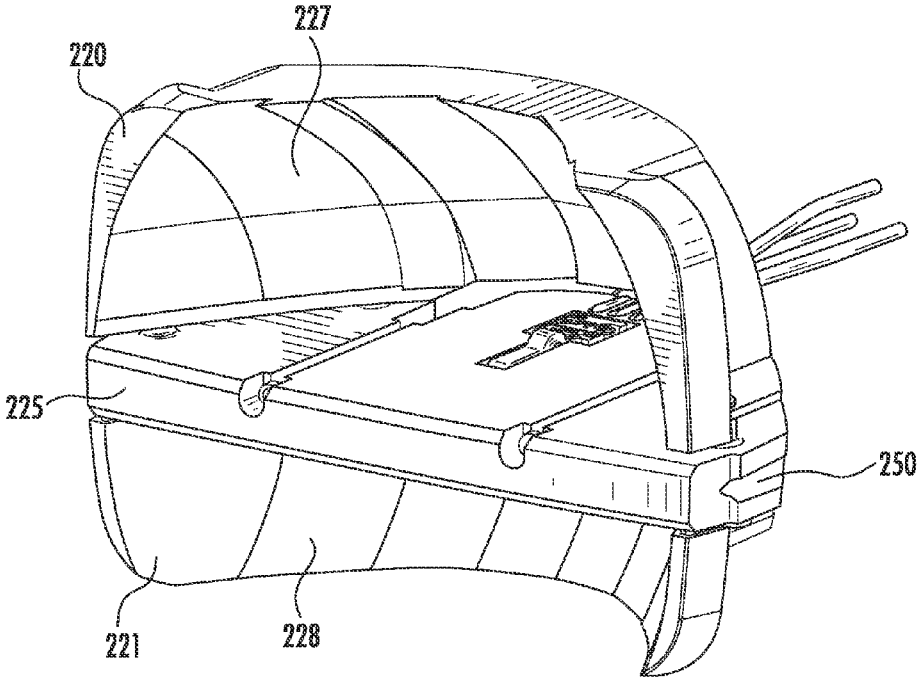
FIGS. 20*a* and 20*b* illustrate the heat sink structure positioned between first and second reflector portions.
Figure 20B:
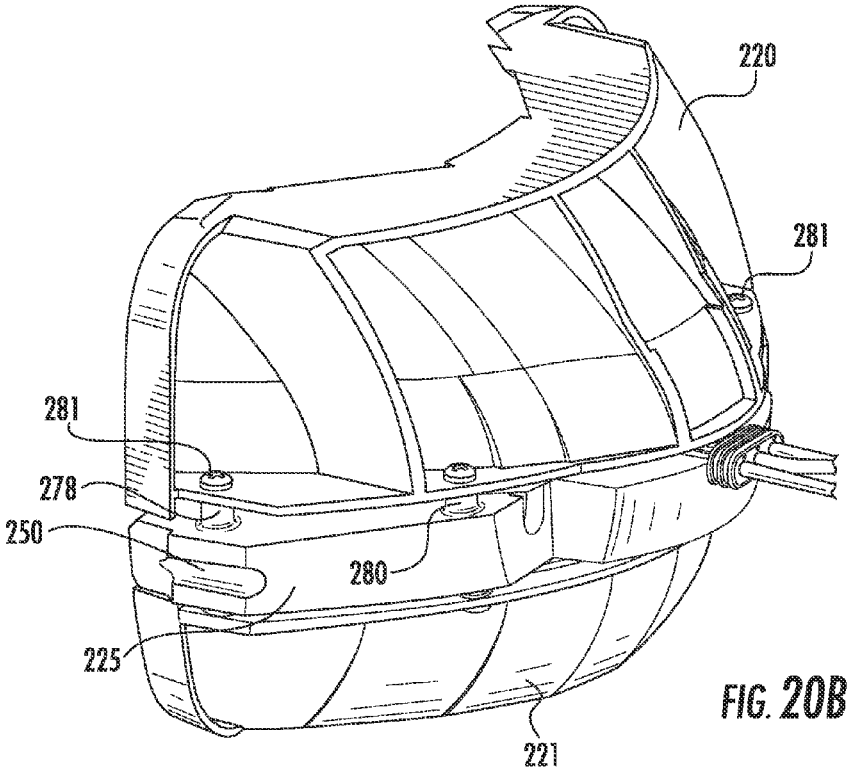

When assembled, as illustrated in FIGS. 20*a* and 20*b*, heat sink structure 225 is positioned between first and second reflector portions 220 and 221, thereby creating an upper area 227 and a lower area 228 in headlamp assembly 210. Heat sink structure 225 prevents light from upper area 227 from impinging on second reflector portion 221 and prevents light from lower area 228 from impinging on first reflector portion 220.

Heat sink abutting edge 345 of second reflector portion 221 contacts heat sink structure 225 to facilitate fastening of second reflector portion 221 to first surface 235 of heat sink structure 225. However, heat sink abutting edge 342 of first reflector portion 220 does not contact heat sink due to upstanding bosses 277-280, which are formed on first surface 235 of heat sink structure 225.

Figure 21:
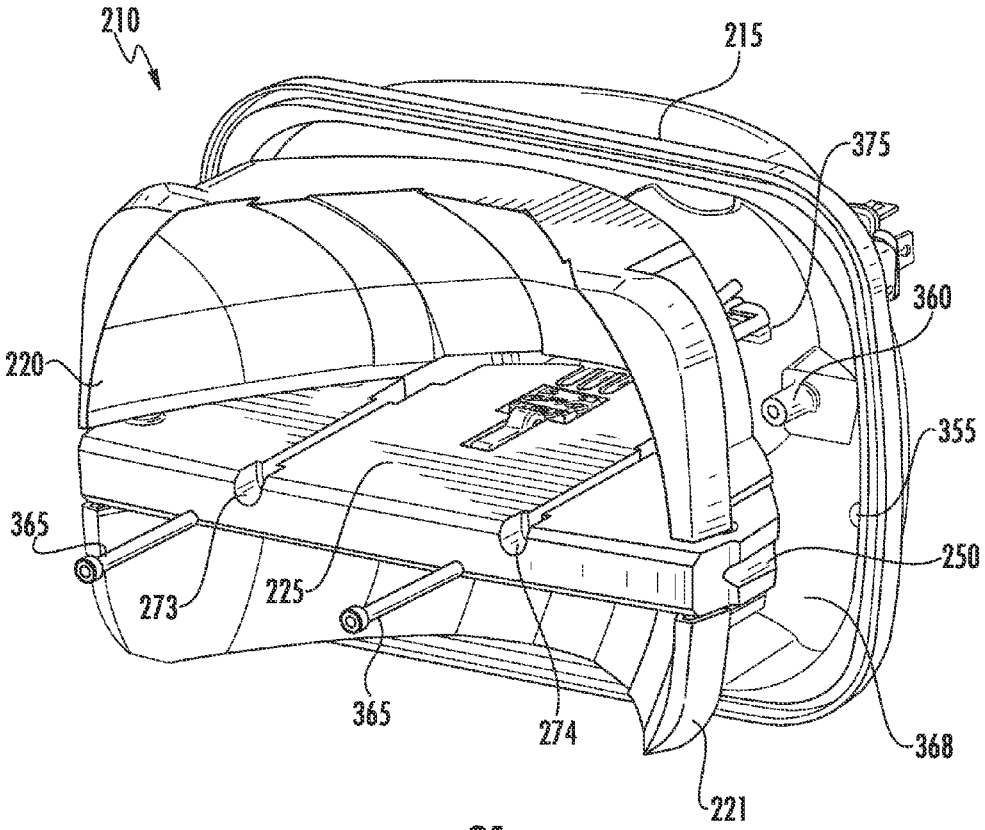
FIG. 21 is an exploded view of the headlamp assembly of FIG. 12.

FIG. 21 is an exploded view of headlamp assembly 210 for illustrating the manner in which heat sink structure 225 and first and second reflector section 220 and 221 are attached to housing 215. As discussed with respect to FIGS. 13 and 14, heat sink structure 225 includes side edges 242 and 243 having alignment slots 250 for aligning heat sink structure 225 within housing 215. Housing 15 includes an alignment member, such as an alignment projection 355, formed on each end thereof. Therefore, alignment slots 250 cooperate with alignments members 335 of housing 215 to ensure that heat sink structure 225 is in a proper position upon insertion into housing 215. Housing 215 includes bosses formed therein, one of which is indicated at 360, for aligning with fastener receiving channels 273 and 274 of heat sink structure 225 and for receiving fasteners, generally indicated at 365, for securing heat sink structure 225 to housing 215. A thermally conductive material, such as thermal grease, phase change material, thermal epoxy, or thermal tape, may be placed heat sink structure 225 and an inner surface 368 of housing 15. An opening 375 for a wire seal is also formed within housing 215 to allow wires 282 to exit housing 215. Housing 215 may be formed of die-cast aluminum that is anodized black for improved thermal emissivity. Housing 215 also functions as a heat sink for first and second light emitting diode assemblies and circuit board 325.

Figure 22:
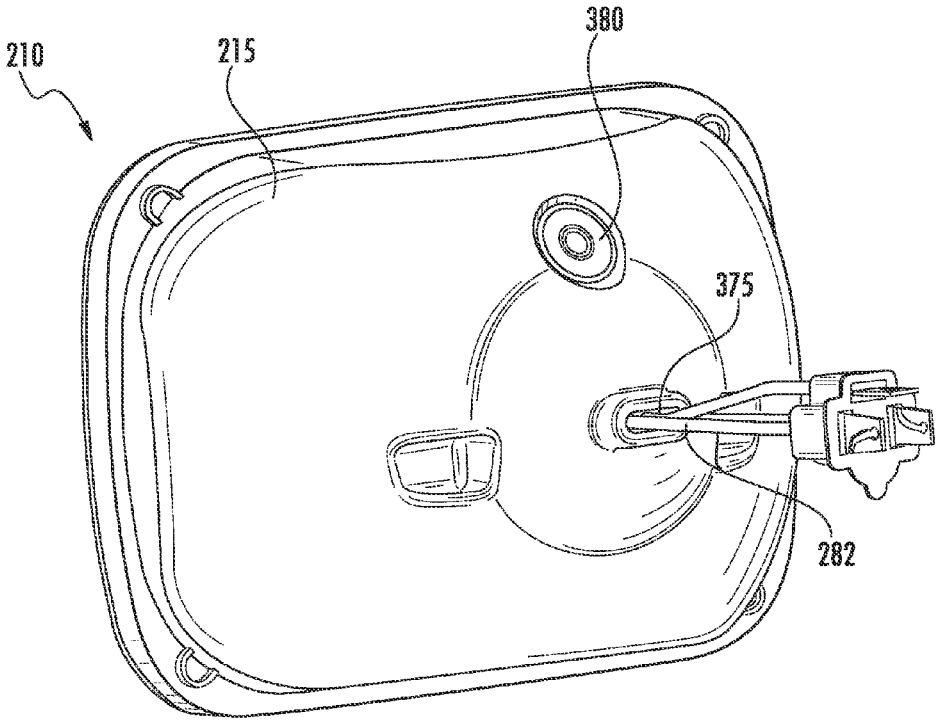
FIG. 22 is back view of the headlamp assembly of FIG. 12.

As illustrated in FIG. 22, housing 215 includes a Gore-Tex patch 380 is placed within an opening in housing 215 to prevent water from entering headlamp assembly 210 while allowing water vapor to escape. Housing 215 serves to provide environmental protection for first and second light emitting diode assemblies, 265 and 290, circuit board 325, and any wiring components. Housing 215 also provides a mounting interface for attaching headlamp assembly 210 to a vehicle.

As discussed above, headlamp 210 emits both a high beam and a low beam. The low beam function uses only first reflector portion and first light emitting diode assembly. The high beam function uses both first and second reflector portion and both first and second light emitting diode assemblies.

Figure 23A:
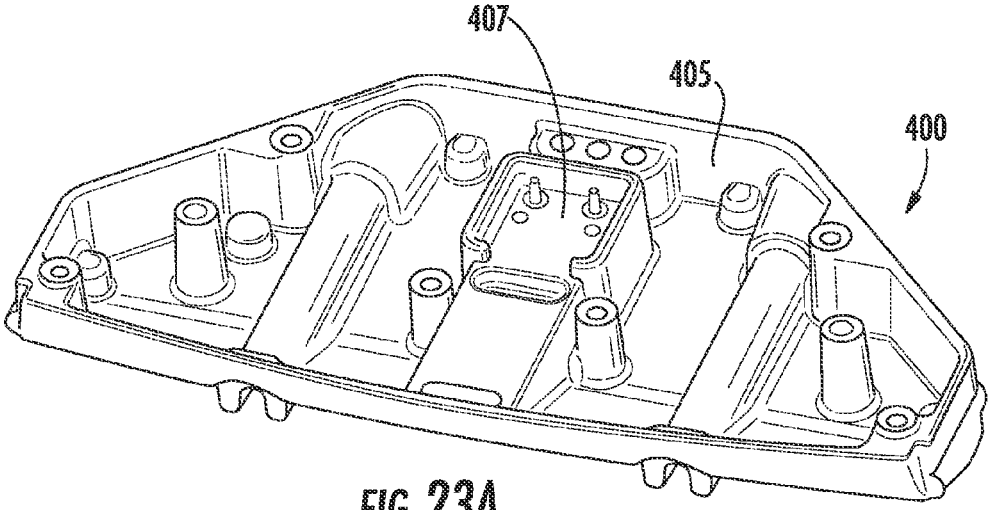
FIGS. 23*a* and 23*b* are alternate embodiments of the heat sink structure.
Figure 23B:
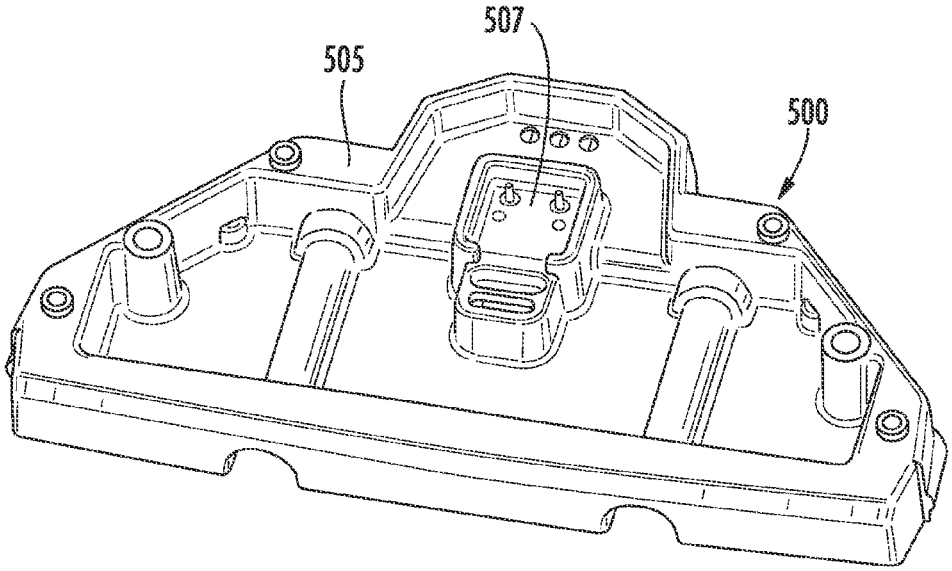

FIGS. 23*a* and 23*b* illustrate additional embodiment of the heat sink structure for a 7-in round headlamp and a 5×7 in headlamp. FIG. 23*a* illustrates a heat sink 400 having a second side 405. Light emitting diode receiving portion 407 is formed therein. The remainder of second surface is hollowed out to allow for various circuit board configurations. Once a circuit board is selected for heat sink 400, second side of heat sink is filled in to surround the circuit board. Similarly, FIG. 23*a* illustrates a heat sink 500 for a 5×7 headlamp assembly. Second surface 505 is illustrated with light emitting diode receiving portion formed therein. Once a circuit board configuration is chosen, the area of second side 505 surrounding the circuit board is filled in.

Figure 24A:
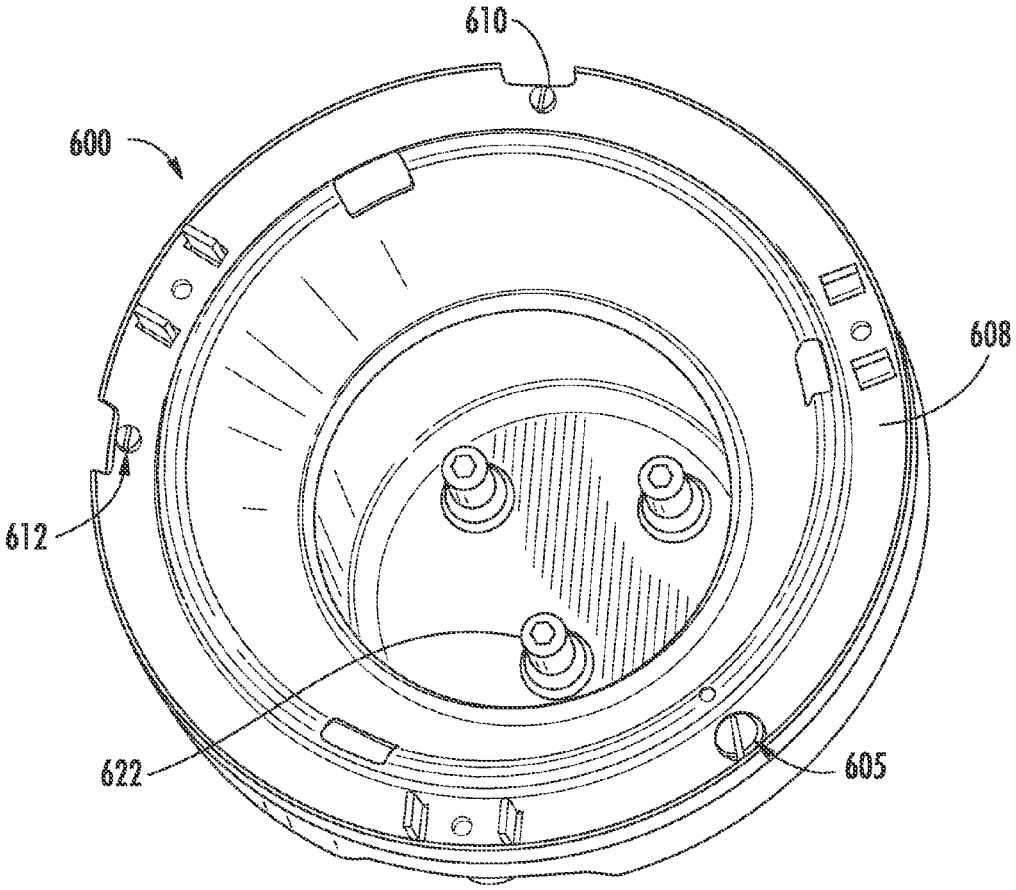
FIG. 24*a* is a front view of a bucket assembly for attaching a headlamp assembly to a vehicle.
Figure 24B:
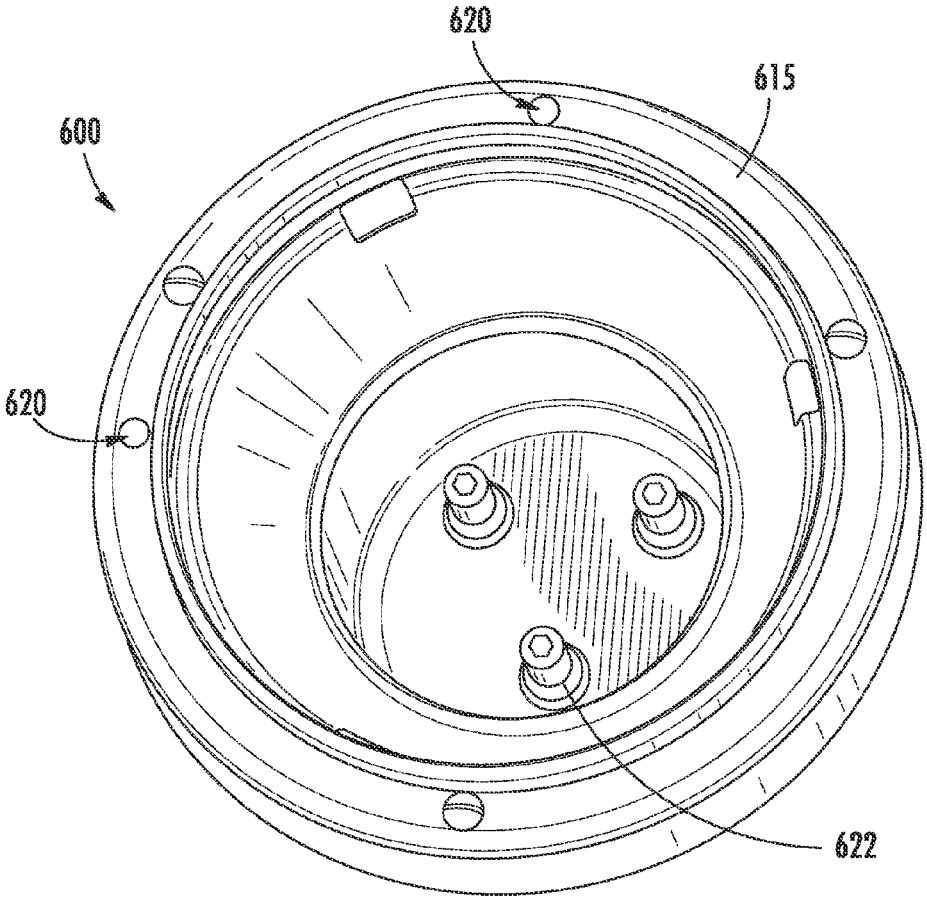
FIG. 24*b* is an additional view of the bucket assembly of FIG. 24*a*.
Figure 24C:
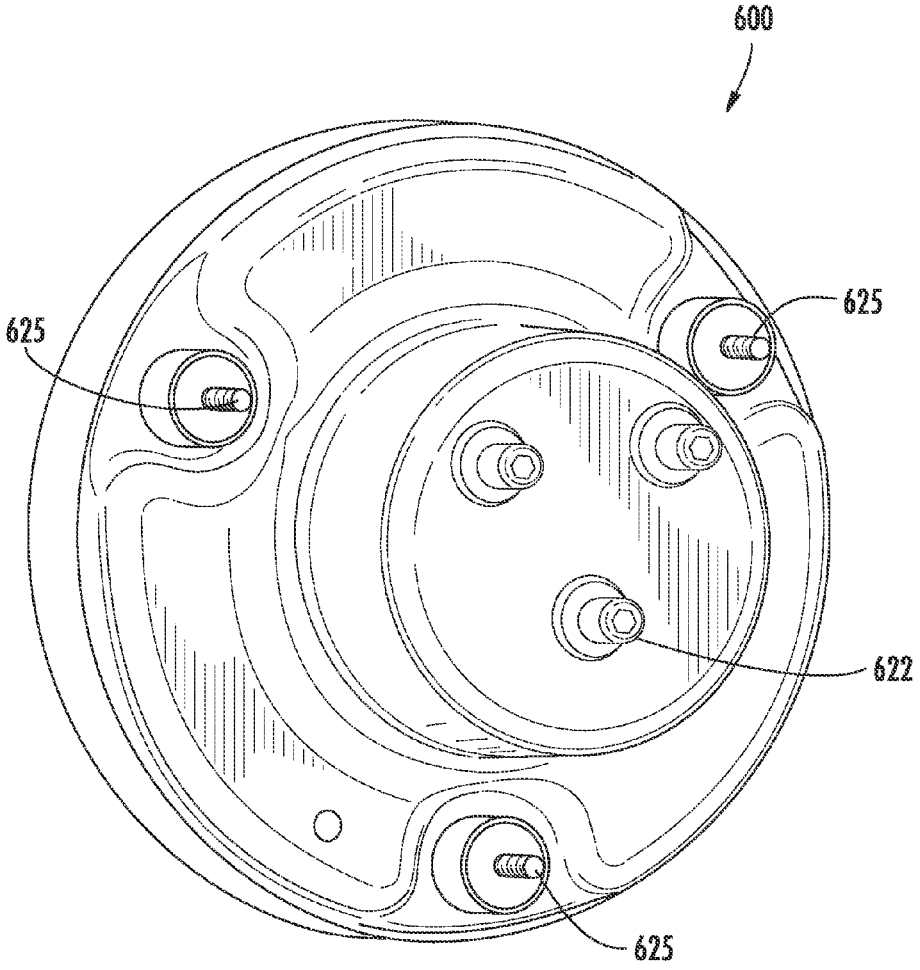
FIG. 24*c* illustrates a back view of the bucket assembly of FIG. 24*a*.
Figure 24D:
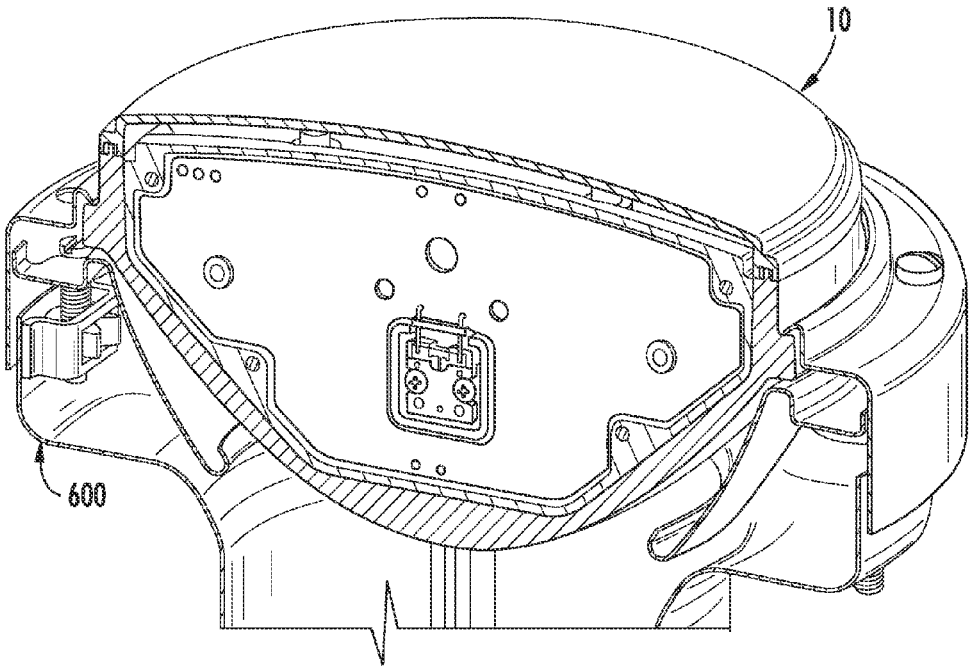
FIG. 24*d* is a cross-sectional view of the bucket assembly with headlamp assembly therein.

FIGS. 24*a*-24*d* illustrate a mounting bucket assembly 600 for headlamp assembly 10. FIG. 24*a* is a front view of bucket assembly 600 having a retention spring 605, a mounting ring 608 in which lamp assembly sits, a vertical aiming screw 610 and a horizontal aiming screw 612. FIG. 24*b* is a view of the bucket assembly 600 of FIG. 24*a*. A bezel or retaining ring 615 is included to retain lamp assembly 10 in bucket assembly 600. Apertures 620 are formed in retaining ring 615 to allow access to vertical aiming screw 610 and horizontal aiming screw 612. FIG. 24*c* illustrates a back view of bucket assembly 600. Threaded fasteners 625 are provided for attaching headlamp assembly 10 and bucket assembly 600 to a vehicle. FIG. 24*d* is a cross-sectional view of bucket assembly 600 retaining headlamp assembly 10 therein. Although shown with respect to the 7-in round headlamp assembly, it should be understood that a corresponding bucket assembly is available for the 5×7 headlamp assembly.

Although the embodiments of the invention herein has been described with reference to particular embodiments, it is to be understood that these embodiments are merely illustrative of the principles and applications of the present invention. For example, the headlamp assembly may include a housing of a 4×6 configuration. It is therefore to be understood that numerous modifications may be made to the illustrative embodiments and that other arrangements may be devised without departing from the spirit and scope of the present invention as defined by the appended claims.

We claim:

1. A headlamp assembly for a vehicle, comprising:

a housing for coupling the headlamp assembly to a vehicle, the housing including a reflector;

a lens;

a heat sink structure having a first surface, a second surface, a first edge, and a second edge;

a circuit board;

a first light emitting diode assembly supported by the first surface of the heat sink structure and a second light emitting diode assembly supported by the second surface of the heat sink structure, each of the first and second light emitting diode assemblies being electrically connected to the circuit board; and wherein the headlamp assembly is adapted to emit a high beam and a low beam and wherein the first edge of the planar heat sink structure is positioned adjacent to the lens and the second edge of the heat sink structure directly contacts an inner surface of the housing, such that the housing is bisected by the heat sink structure.

2. The headlamp assembly of claim 1, wherein the heat sink structure is removably attached to the housing.

3. The headlamp assembly of claim 1, wherein the second edge of said heat sink structure directly contacts the inner surface of the housing for a majority of said second edge such that the housing is bisected into first and second areas by the heat sink structure.

4. The headlamp assembly of claim 3, wherein the housing abutting edge of the heat sink structure includes alignment ribs positioned thereon for facilitating the attachment of the heat sink structure to the housing.

5. The headlamp assembly of claim 1, wherein the first surface of the heat sink structure includes a light emitting diode receiving portion formed therein to support the first light emitting diode assembly in a same plane as the first surface and the second surface of the heat sink structure includes a second light emitting diode receiving portion formed therein and a circuit board receiving portion formed therein to support the second light emitting diode assembly and the circuit board in a same plane as the second surface.

6. The headlamp assembly of claim 1, wherein the reflector has substantially the same shape as the inner surface of the housing and is positioned adjacent to the inner surface of the housing.

7. The headlamp assembly of claim 6, wherein illumination of the first light emitting diode assembly results in a low beam, and wherein illumination of both the first light emitting diode assembly and the second light emitting diode assembly results in a high beam.

8. The headlamp assembly of claim 1, wherein the heat sink structure is made of anodized black die-cast aluminum to facilitate thermal emissivity.

9. The headlamp assembly of claim 6, wherein the first and second light emitting diode receiving portions include alignment posts formed therein for positioning the first and second light emitting diode assemblies on the heat sink structure.

10. The headlamp assembly of claim 9, wherein the first and second light emitting diode assemblies are further secured to the heat sink structure with fasteners.

11. The headlamp assembly of claim 1, wherein a thermally conductive compound is positioned between the heat sink structure and the first light emitting diode assembly and between the heat sink structure and the second light emitting diode assembly.

12. The headlamp assembly of claim 1, further comprising a combined BUSS bar and light blinder assembly positioned on the first surface of the heat sink structure for electrically connecting the circuit board to the first light emitting diode assembly and for blocking a portion of light from the first light emitting diode assembly.

13. The headlamp assembly of claim 12, wherein the combined BUSS bar and light blinder assembly is over-molded with glass filled nylon.

14. The headlamp assembly of claim 12, wherein the combined BUSS bar and light blinder assembly blocks light from 10° U to 90° U in photometric pattern.

15. A heat sink structure for use in a headlamp assembly with a housing, a reflector, a circuit board and first and second light emitting diodes, the heat sink structure comprising:

a body having a housing abutting edge and a lens adjacent edge, the housing abutting edge directly contacting an inner surface of the housing and adapted to bisect the housing into first and second sections;

a first surface of the body having a first light emitting diode receiving portion formed therein to support the first light emitting diode in a same plane as the first surface; and a second surface of the body having a second light emitting diode receiving portion and a circuit board receiving portion formed therein to support the second light emitting diode and the circuit board in a same plane as the second surface.

16. The heat sink structure of claim 15, wherein the housing abutting edge of the body includes alignment ribs positioned thereon for facilitating attachment of the heat sink structure to the housing.

17. The heat sink structure of claim 15, wherein the heat sink structure is made of anodized black die-cast aluminum to facilitate thermal emissivity.

18. The heat sink structure of claim 15, wherein the first and second light emitting diode receiving portions include alignment posts formed therein for positioning the first and second light emitting diodes on the body.

19. The heat sink structure of claim 18, wherein the first and second light emitting diode receiving portions include apertures for receiving fasteners for further securing the first and second light emitting diodes on the body.

20. A headlamp assembly for a vehicle, comprising:

a housing for coupling the headlamp assembly to a vehicle, the housing including an inner surface defined by a reflector;

a heat sink structure having a first surface, a second surface, a housing abutting edge and a lens adjacent edge, the housing abutting edge directly abutting an inner surface of the housing, wherein the heat sink structure is adapted to separate the housing into first and second sections;

a circuit board supported by the second surface of the heat sink structure, the circuit board being positioned near the lens adjacent edge of the heat sink structure;

a first light emitting diode being supported by the first surface of the heat sink structure and being electrically connected to the circuit board, the first light emitting diode lying in substantially the same plane as the first surface of the heat sink structure; and a second light emitting diode being supported by the second surface of the heat sink structure and being electrically connected to the circuit board, the second light emitting diode being positioned between the housing abutting edge of the heat sink structure and the circuit board, wherein the circuit board and the second light emitting diode each lie in substantially the same plane as the second surface of the heat sink structure and do not overlap.

21. The headlamp assembly of claim 20, wherein the housing abutting edge of said heat sink structure directly contacts the inner surface of the housing for a majority of said housing abutting edge.

22. The headlamp assembly of claim 21, wherein the housing abutting edge of the heat sink structure includes alignment ribs positioned thereon for facilitating the attachment of the heat sink structure to the housing.

23. The headlamp assembly of claim 20, wherein the headlamp assembly is adapted to emit a high beam and a low beam, wherein illumination of the first light emitting diode results in a low beam, and wherein illumination of both the first light emitting diode and the second light emitting diode results in a high beam.

24. The headlamp assembly of claim 20, wherein the heat sink structure is made of a material for facilitating thermal emissivity.

25. The headlamp assembly of claim 24, wherein the heat sink structure is made of anodized black die-cast aluminum.

26. The headlamp assembly of claim 20, wherein the first and second light emitting diode receiving portions include alignment posts formed therein for positioning the first and second light emitting diodes.

27. The headlamp assembly of claim 26, wherein the first and second light emitting diodes are further secured to the heat sink structure with fasteners.

28. The headlamp assembly of claim 25, wherein a thermally conductive compound is positioned between the heat sink structure and the first light emitting diode and between the heat sink structure and the second light emitting diode.

29. The headlamp assembly of claim 25, further comprising a combined BUSS bar and light blinder assembly positioned on the first surface of the heat sink structure for electrically connecting the circuit board to the first light emitting diode and for blocking a portion of light from the first light emitting diode.

30. The headlamp assembly of claim 29, wherein the combined BUSS bar and light blinder assembly is over-molded with glass filled nylon.

31. The headlamp assembly of claim 29, wherein the combined BUSS bar and light blinder blocks light from 10° U to 90° U in photometric pattern.

32. A heat sink structure for use in a headlamp assembly with a housing, a reflector, a circuit board and first and second light emitting diodes, the heat sink structure comprising:

a heat sink body having a first surface, a second surface, a housing abutting edge and a lens adjacent edge, the housing abutting edge directly contacting an inner surface of the housing;

a first surface of the body having a first light emitting diode receiving portion formed therein to support the first light emitting diode in a same plane as the first surface;

a second surface of the body having a second light emitting diode receiving portion and a circuit board receiving portion formed therein, the circuit board receiving portion being positioned near the lens adjacent edge of the heat sink and the light emitting diode receiving portion being positioned near the housing abutting edge of the heat sink structure, wherein the second light emitting diode receiving portion and a circuit board receiving portion are adapted to support the second light emitting diode and the circuit board in a same plane as the second surface; and wherein the heat sink is adapted to bisect the housing into first and second sections.

33. The heat sink structure of claim 32, wherein the housing abutting edge of the body includes alignment ribs positioned thereon for facilitating attachment of the heat sink structure to the housing and said housing abutting edge directly contacting the inner surface of the housing for a majority of said housing abutting edge.

34. The heat sink structure of claim 32, wherein the heat sink structure is made of anodized black die-cast aluminum to facilitate thermal emissivity.

35. The heat sink structure of claim 32, wherein the first and second light emitting diode receiving portions include alignment posts formed therein for positioning the first and second light emitting diodes.

36. The heat sink structure of claim 35, wherein the first and second light emitting diode receiving portions include apertures for receiving fasteners for further securing the first and second light emitting diodes.

37. A headlamp assembly for a vehicle, comprising:

a housing for coupling the headlamp assembly to a vehicle, the housing including an inner surface and a reflector;

a heat sink structure having a first surface, a second surface, a housing abutting edge and a lens adjacent edge, the housing abutting edge directly contacting an inner surface of the housing such that the housing is bisected into first and second sections by the heat sink structure;

a circuit board supported by the second surface of the heat sink structure, the circuit board including a cut out portion formed therein;

a first light emitting diode being supported by the first surface of the heat sink structure and being electrically connected to the circuit board, the first light emitting diode lying in substantially the same plane as the first surface of the heat sink structure; and a second light emitting diode being supported by the second surface of the heat sink structure and being electrically connected to the circuit board, the second light emitting diode being positioned in the cut out portion of the circuit board such that the circuit board surrounds the second light emitting diode, wherein the circuit board and the second light emitting diode lie in substantially the same plane as the second surface of the heat sink structure.

38. The headlamp assembly of claim 37, wherein the housing abutting edge of said heat sink structure directly contacts the inner surface of the housing for a majority of said housing abutting edge.

39. The headlamp assembly of claim 38, wherein the housing abutting edge of the heat sink structure includes alignment ribs positioned thereon for facilitating the attachment of the heat sink structure to the housing.

40. The headlamp assembly of claim 37, wherein the headlamp assembly is adapted to emit a high beam and a low beam, wherein illumination of the first light emitting diode results in a low beam, and wherein illumination of both the first light emitting diode and the second light emitting diode results in a high beam.

41. The headlamp assembly of claim 37, wherein the heat sink structure is made of anodized black die-cast aluminum to facilitate thermal emissivity.

42. The headlamp assembly of claim 37, wherein the first and second light emitting diode receiving portions include alignment posts formed therein for positioning the first and second light emitting diodes on the heat sink structure.

43. The headlamp assembly of claim 38, wherein the reflector has substantially the same shape as the inner surface of the housing and is positioned adjacent to the inner surface of the housing.

44. The headlamp assembly of claim 37, wherein a thermally conductive compound is positioned between the heat sink structure and the first light emitting diode and between the heat sink structure and the second light emitting diode.

45. The headlamp assembly of claim 37, further comprising a combined BUSS bar and light blinder assembly positioned on the first surface of the heat sink structure for electrically connecting the circuit board to the first light emitting diode and for blocking a portion of light from the first light emitting diode.

46. The headlamp assembly of claim 45, wherein the combined BUSS bar and light blinder assembly is over-molded with glass filled nylon.

47. The headlamp assembly of claim 45, wherein the combined BUSS bar and light blinder blocks light from 10° U to 90° U in photometric pattern.

48. A heat sink structure for use in a headlamp assembly with a housing, a reflector, a circuit board and first and second light emitting diodes, the heat sink structure comprising:

a body having a first surface, a second surface, a housing abutting edge and a lens adjacent edge, the housing abutting edge directly contacting an inner surface of the housing such that the housing is bisected into first and second sections by the body;

a first surface of the body having a first light emitting diode receiving portion formed therein to support the first light emitting diode in a same plane as the first surface; and a second surface of the body having a second light emitting diode receiving portion and a circuit board receiving portion formed therein, the circuit board receiving portion being formed around the second light emitting diode receiving portion such that the second surface is adapted to hold a circuit board having a cut out portion formed therein for receiving the second light emitting diode.

49. The heat sink structure of claim 48, wherein the housing abutting edge of the body includes alignment ribs positioned thereon for facilitating attachment of the body to the housing.

50. The heat sink structure of claim 48, wherein the heat sink structure is made of anodized black die-cast aluminum to facilitate thermal emissivity.

51. The heat sink structure of claim 48, wherein the first and second light emitting diode receiving portions include alignment posts formed therein for positioning the first and second light emitting diodes.

52. The heat sink structure of claim 51, wherein the first and second light emitting diode receiving portions include apertures for receiving fasteners for further securing the first and second light emitting diodes.

53. A headlamp assembly for a vehicle, comprising:

a housing for coupling the headlamp assembly to a vehicle, the housing including a reflector;

a heat sink structure having a first surface and a second surface, a housing abutting edge and a lens adjacent edge, the housing abutting edge directly contacting an inner surface of the housing for a majority of the housing abutting edge such that the housing is bisected into first and second sections by the heat sink structure;

a circuit board;

a first light emitting diode assembly supported by the first surface of the heat sink structure and a second light emitting diode assembly supported by the second surface of the heat sink structure, each light emitting diode assembly being electrically connected to the circuit board; and wherein the headlamp assembly is adapted to emit a low beam when one of the first or second light emitting diode assemblies is activated and adapted to emit a high beam when both of the first and second light emitting diode assemblies are activated.

54. The headlamp assembly of claim 53, wherein the housing abutting edge of the heat sink structure includes alignment ribs positioned thereon for facilitating attachment of the heat sink structure to the housing.

55. The headlamp assembly of claim 53, wherein the first surface of the heat sink structure includes a light emitting diode receiving portion formed therein to support the first light emitting diode assembly in a same plane as the first surface.

56. The headlamp assembly of claim 55, wherein the second surface of the heat sink structure includes a second light emitting diode receiving portion formed therein and a circuit board receiving portion formed therein to support the second light emitting diode assembly and the circuit board in a same plane as the second surface.

57. The headlamp assembly of claim 53, wherein the heat sink structure is made of anodized black die-cast aluminum to facilitate thermal emissivity.

58. The headlamp assembly of claim 56, wherein the first and second light emitting diode receiving portions include alignment posts formed therein for positioning the light emitting diode assembly and the first and second light emitting diode assemblies are further secured to the heat sink structure with fasteners.

59. The headlamp assembly of claim 53, wherein the reflector has substantially the same shape as an inner surface of the housing and is positioned adjacent to the inner surface of the housing.

60. The headlamp assembly of claim 53, wherein a thermally conductive compound is positioned between the heat sink structure and the first light emitting diode assembly and between the heat sink structure and the second light emitting diode assembly.

61. The headlamp assembly of claim 53, further comprising a combined BUSS bar and light blinder assembly positioned on the first surface of the heat sink for electrically connecting the circuit board to the first light emitting diode assembly and for blocking a portion of light from the first light emitting diode assembly.

62. The headlamp assembly of claim 61, wherein the combined BUSS bar and light blinder assembly is over-molded with glass filled nylon.

63. The headlamp assembly of claim 62, wherein the combined BUSS bar and light blinder blocks light from 10° U to 90° U in photometric pattern.

64. A headlamp assembly for a vehicle comprising:

a seven-inch round headlamp housing for coupling the headlamp assembly to a vehicle, the housing including a reflector and a lens, the reflector having substantially the same shape as an inner surface of the housing being positioned adjacent to the inner surface of the housing;

a heat sink structure having a first surface and a second surface, a housing abutting edge and a lens adjacent edge, the housing abutting edge directly contacting an inner surface of the housing and the lens adjacent edge positioned adjacent to the lens, the heat sink being removably coupled to the housing;

a circuit board;

at least one first light emitting diode supported by the first surface of the heat sink structure and at least one second light emitting diode supported by the second surface of the heat sink structure, each light emitting diode being electrically connected to the circuit board; and wherein the headlamp assembly is adapted to emit a high beam and a low beam and wherein the headlamp assembly is bisected by the heat sink structure.

65. The headlamp assembly of claim 64, wherein the housing abutting edge of the heat sink structure includes alignment ribs positioned thereon for facilitating attachment of the heat sink structure to the housing.

66. The headlamp assembly of claim 64, wherein the first surface of the heat sink structure includes a first light emitting diode receiving portion formed therein to support the at least one first light emitting diode assembly in a same plane as the first surface.

67. The headlamp assembly of claim 66, wherein the second surface of the heat sink structure includes a second light emitting diode receiving portion formed therein and a circuit board receiving portion formed therein to support the second light emitting diode assembly and the circuit board, the circuit board being positioned near the lens adjacent edge of the heat sink and, the second light emitting diode being positioned between the housing abutting edge of the heat sink structure and the circuit board, wherein the circuit board and the second light emitting diode assembly each lie in substantially the same plane as the second surface of the heat sink structure and do not overlap.

68. The headlamp assembly of claim 64, wherein the heat sink structure is made of anodized black die-cast aluminum to facilitate thermal emissivity.

69. The headlamp assembly of claim 67, wherein the first and second light emitting diode receiving portions include alignment posts formed therein for positioning the light emitting diode assembly on the heat sink structure.

70. The headlamp assembly of claim 64, wherein the housing abutting edge directly contacts the inner surface of the housing for a majority of the housing abutting edge such that the housing is bisected into first and second sections by the heat sink structure.

71. The headlamp assembly of claim 64, wherein a thermally conductive compound is positioned between the heat sink structure and the first light emitting diode assembly and between the heat sink structure and the second light emitting diode assembly.

72. The headlamp assembly of claim 67, further comprising a combined BUSS bar and light blinder assembly positioned on the first surface of the heat sink for electrically connecting the circuit board to the first light emitting diode assembly and for blocking a portion of light from the first light emitting diode assembly.

73. The headlamp assembly of claim 72, wherein the combined BUSS bar and light blinder assembly is over-molded with glass filled nylon.

74. The headlamp assembly of claim 72, wherein the combined BUSS bar and light blinder blocks light from 10° U to 90° U in photometric pattern.

75. A headlamp assembly for a vehicle comprising:

a rectangular headlamp housing for coupling the headlamp assembly to a vehicle, the housing including a reflector and a lens, the reflector having substantially the same shape as an inner surface of the housing and being positioned adjacent to the inner surface of the housing;

a heat sink structure having a first surface and a second surface, a housing abutting edge and a lens adjacent edge, the housing abutting edge directly contacting an inner surface of the housing;

a circuit board;

at least one first light emitting diode assembly supported by the first surface of the heat sink structure and at least one second light emitting diode assembly supported by the second surface of the heat sink structure, each light emitting diode assembly being electrically connected to the circuit board; and wherein the headlamp assembly is adapted to emit a high beam and a low beam and wherein the lens adjacent edge of the heat sink structure is positioned adjacent to the lens, such that the headlamp assembly is bisected by the heat sink structure.

76. The headlamp assembly of claim 75, wherein the housing abutting edge of the heat sink structure includes alignment ribs positioned thereon for facilitating attachment of the heat sink structure to the housing.

77. The headlamp assembly of claim 75, wherein the first surface of the heat sink structure includes a first light emitting diode receiving portion formed therein to support the first light emitting diode assembly in a same plane as the first surface.

78. The headlamp assembly of claim 77, wherein the second surface of the heat sink structure includes a second light emitting diode receiving portion formed therein and a circuit board receiving portion formed therein to support the second light emitting diode assembly and the circuit board, the circuit board receiving portion being formed around the second light emitting diode receiving portion such that the second surface is adapted to hold a circuit board having a cut out portion formed therein for receiving the second light emitting diode assembly.

79. The headlamp assembly of claim 75, wherein the heat sink structure is made of anodized black die-cast aluminum to facilitate thermal emissivity.

80. The headlamp assembly of claim 78, wherein the first and second light emitting diode receiving portions include alignment posts formed therein for positioning the light emitting diode assembly on the heat sink structure.

81. The headlamp assembly of claim 80, wherein the first and second light emitting diode assemblies are further secured to the heat sink structure with fasteners.

82. The headlamp assembly of claim 75, wherein a thermally conductive compound is positioned between the heat sink structure and the first light emitting diode assembly and between the heat sink structure and the second light emitting diode assembly.

83. The headlamp assembly of claim 75 wherein the housing abutting edge directly contacts the inner surface of the housing for a majority of the housing abutting edge such that the housing is bisected into first and second sections by the heat sink structure.

* * * * *